US008083337B2

(12) United States Patent
Takekoshi et al.

(10) Patent No.: US 8,083,337 B2
(45) Date of Patent: Dec. 27, 2011

(54) INK JET PRINTING APPARATUS, INK JET PRINTING METHOD, DATA GENERATING APPARATUS, COMPUTER PROGRAM, AND INK JET PRINTING SYSTEM

(75) Inventors: Rie Takekoshi, Kawasaki (JP); Takao Ogata, Tokyo (JP); Takumi Kaneko, Tokyo (JP); Noboru Kunimine, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 646 days.

(21) Appl. No.: 12/209,883

(22) Filed: Sep. 12, 2008

(65) Prior Publication Data

US 2009/0073204 A1 Mar. 19, 2009

(30) Foreign Application Priority Data

Sep. 19, 2007 (JP) ..... 2007-242665

(51) Int. Cl.
*B41J 29/38* (2006.01)

(52) U.S. Cl. ..... 347/98; 347/5; 347/14

(58) Field of Classification Search ..... 347/5, 9, 347/11, 12, 19, 14, 98
See application file for complete search history.

(56) References Cited

U.S. PATENT DOCUMENTS

| | | | | |
|---|---|---|---|---|
| 5,864,350 | A | 1/1999 | Shioya et al. | |
| 2003/0202026 | A1 * | 10/2003 | Smith et al. | 347/12 |
| 2009/0073203 | A1 | 3/2009 | Takekoshi et al. | |

FOREIGN PATENT DOCUMENTS

| | | | |
|---|---|---|---|
| JP | 2000-153677 | A | 6/2000 |
| JP | 3190535 | A | 5/2001 |
| JP | 2003-170650 | A | 6/2003 |
| JP | 2005-081754 | A | 3/2005 |

* cited by examiner

*Primary Examiner* — Lam S Nguyen
(74) *Attorney, Agent, or Firm* — Fitzpatrick, Cella, Harper & Scinto

(57) ABSTRACT

The present invention provides an ink jet printing apparatus, an ink jet printing method, a data generation apparatus, a computer program, and an ink jet printing system by which a timing for ejecting a processing liquid can be changed to improve image performance of a printed image such as abrasion resistance, to provide the printing head with a longer life, and to improve a throughput. The processing liquid is ejected to a predetermined area on a printing medium, for which a formation of an image by ink is completed, in two or more scannings among five scannings of the printing head. When an amount of ejection data for ejecting the processing liquid in the fifth scanning for ejecting only the processing liquid is equal to or lower than a predetermined amount, the fifth scanning is not carried out.

6 Claims, 19 Drawing Sheets

PROCESSING LIQUID EJECTION PATTERN

EJECTION DATA (C, M)

| | | | | |
|---|---|---|---|---|
| C | C M | C | M | |
| C | C M | M | | |
| C | M | M | | |
| M | | | C | |
| | | | | |

DATA C

FIRST SCANNING

SECOND SCANNING

THIRD SCANNING

FOURTH SCANNING

DATA M

FIRST SCANNING

SECOND SCANNING

THIRD SCANNING

FOURTH SCANNING (C+M) DATA

FIRST SCANNING

| | | | | |
|---|---|---|---|---|
| C | | | | |
| | | | | |
| | M | | | |
| | | | | |
| | | | | |

FIG.10A

SECOND SCANNING

| | | | | |
|---|---|---|---|---|
| | | C | | |
| C | M | | | |
| | | M | | |
| M | | | C | |
| | | | | |

FIG.10B

THIRD SCANNING

| | | | | |
|---|---|---|---|---|
| | M | | M | |
| | C | | | |
| C | | M | | |
| | | | | |
| | | | | |

FIG.10C

FOURTH SCANNING

| | | | | |
|---|---|---|---|---|
| | C | | | |
| | | M | | |
| | | | | |
| | | | | |
| | | | | |

FIG.10D

SCANNING NUMBER AT COMPLETION OF IMAGE FORMATION

| | | | | |
|---|---|---|---|---|
| 1 | 4 | 2 | 3 | |
| 2 | 3 | 4 | | |
| 3 | 1 | 3 | | |
| 2 | | | 2 | |
| | | | | |

FIG.11

| | | | | |
|---|---|---|---|---|
| 2 | 5 | 3 | 4 | |
| 3 | 4 | 5 | 1 | |
| 4 | 2 | 4 | 1 | |
| 3 | 1 | 1 | 3 | |
| | | | | |

FIG.12

| | | | | |
|---|---|---|---|---|
| 2 | | 3 | | |
| | 4 | | 1 | |
| 4 | | 4 | | |
| | 1 | | 3 | |
| | | | | |

FIG.13

PROCESSING LIQUID EJECTION DATA

FIRST SCANNING

SECOND SCANNING

THIRD SCANNING

FOURTH SCANNING

FIFTH SCANNING

INK JET PRINTING APPARATUS, INK JET PRINTING METHOD, DATA GENERATING APPARATUS, COMPUTER PROGRAM, AND INK JET PRINTING SYSTEM

BACKGROUND OF THE INVENTION

1. Field of the Invention

The present invention relates to an ink jet printing apparatus, an ink jet printing method, data generating apparatus, computer program, and ink jet printing system by which a printing head that can eject an ink and a processing liquid is caused to scan a predetermined area on a printing medium a plurality of times to form an image by the ink on the printing medium and to cover the formed image by the processing liquid.

2. Description of the Related Art

In recent years, an ink jet printing apparatus has been widely used, with printed images having higher definition, for public display application and commercial display applications such as photographs, posters, and graphic prints. In the case of images formed for public display application and commercial display application, a requirement for high definition as well as a requirement for improving the image quality (e.g., uniform glossiness, bronze characteristic) and a requirement for improving the image toughness showing the strength and the long-term storage stability of the image. The bronze characteristic means a degree at which a color different from that of illumination light is reflected due to the bronze phenomenon when illumination light has mirror reflection (specular reflection) at an image surface. The bronze characteristic is known as being remarkable in a cyan ink in particular.

Coloring ink used in an ink jet printing apparatus is mainly classified to the dye-base one and the pigment-base one. Dye ink includes coloring dye dissolved in water or alcoholic medium in a molecular state and thus has a characteristic that dye ink is more transparent than pigment ink and provides superior color production. However, dye ink is disadvantageous in that early discoloring is caused due to ultraviolet light or active gas in air. On the other hand, pigment ink has a superior discoloring resistance in its long-term storage. In recent years, advanced manufacture techniques has allowed pigment ink to establish both of the long-term storage stability unique to pigment ink and superior color production equal to that of dye ink. Thus, more ink jet printing apparatuses use pigment ink mainly for demanding commercial printing applications such as photographs and posters where a printed image must be stored for a long term.

However, the application using pigment as described above in particular still has the conventional image quality-related problems such as the one where the glossiness of images tends to unequal and the one where the bronze phenomenon is caused as typical in pigment cyan ink. Another problem is that an increased number of display applications such as posters show a weaker image toughness that shows an image strength and a long-term storage stability compared to those of an offset-printed image for example.

The following section will exemplarily describe the problem of an abrasion resistance among the image toughness-related problems. The main problem is that an image printed on a glossy paper by pigment ink is easily damaged even in general handling operation steps such as the subsequent handling and display occasions.

FIG. 20A is a schematic view illustrating the cross section of an image formed by using a pigment ink on a printing medium having thereon an ink absorbing layer. The following section will described the reason why the image formed on a glossy paper by the pigment ink is easily damaged with reference to FIG. 20A.

A printing medium used for an ink jet printing apparatus is structured so that the surface of a base member (not shown) such as a paper or a film has thereon an ink absorbing layer 24 for the purpose of absorbing an ink. In order to reduce the oozing of the ink for example, the ink absorbing layer 24 includes a great amount of inorganic fine particles of silica or alumina for example that is highly-absorptive to ink solvent. A printing medium used for the printing of a photograph such as a glossy paper must have a flat and smooth surface and thus generally uses inorganic particles on the order of submicron. Thus, a gap among inorganic fine particles formed in the ink absorbing layer 24 is proportional to the particles diameter and thus is formed by a fine pore on the order of submicron.

On the other hand, in the pigment ink, coloring pigment particles of about 100 nanometer are dispersed. This prevents, when the coloring pigment particles has a diameter larger than that of the fine pores of the ink absorbing layer 24, the coloring pigment particles from entering the ink absorbing layer 24. In this case, the coloring pigment particles remain on the surface of the ink absorbing layer 24 as if they are blocked by a filter. In the case of a printing medium such as a glossy paper, the coloring pigment particles generally has a diameter larger than that of the fine pores of the ink absorbing layer 24. Thus, a pigment ink layer 25 is formed on the surface of the ink absorbing layer 24.

Due to the pigment ink layer 25 formed on the surface of the ink absorbing layer 24 as described above, the image surface is easily damaged when an external force is applied to the pigment ink layer 25. In some cases, the pigment ink layer 25 (image) may be peeled due to an external force. Due to the reason as described above, the image formed by the pigment ink has been considered as being frequently involved with abrasion resistance-related problems.

Japanese Patent Laid-Open No. 2000-153677 discloses a laminate film method to protect an image formed by a pigment ink by covering the printed face of the image by a cover film. Japanese Patent Laid-Open No. 2005-81754 discloses a liquid laminate method to cover the printed face of the image by transparent resin liquid. Japanese Patent Laid-Open No. 2003-170650 discloses a post-processing method to mix thermoplastic resin particles in the ink absorbing layer of a printing medium to print an image by a pigment ink to subsequently heat the printing medium to adhere a pigment ink layer to the ink absorbing layer.

In the case of the laminate film method, the abrasion resistance-related problem can be solved by the image surface covered by the resin film having a high film strength. However, the image surface covered by the film deteriorates the original texture of the printing medium such as a paper. The laminate processing also causes an increased cost because another apparatus different from a printing apparatus is required.

The liquid laminate method can carry out, just after the printing of the image, the liquid laminate processing in the same printing apparatus. However, in order to obtain the sufficient effect of the abrasion resistance, a film thickness of a few microns must be formed to deteriorate, as in the laminate film method, the original texture of the printing medium such as a paper. As disclosed in Japanese Patent Laid-Open No. 2005-81754, a further higher abrasion resistance is practically required when a thin film having a thickness equal to or lower than 1 micron is formed.

In the case of the post-processing method, types of printing media for which an improved abrasion resistance can be expected are limited and a heating processing step is required to cause the apparatus to have a larger size.

The problem of the abrasion resistance as described above can be very effectively solved by forming a transparent layer on the top layer of the pigment ink layer 25 on the glossy paper to reduce the dynamic friction coefficient of the image surface. To solve this, a configuration has been suggested for an ink jet printing apparatus in recent years to use a glossy paper including a transparent layer by formed a processing liquid including resin having an abrasion resistance function to print an image.

FIG. 20B is a schematic view illustrating the cross section of an image having thereon a transparent layer formed by a processing liquid. A transparent layer 26 of the processing liquid is formed on the outermost surface so as to cover the pigment ink layer 25. By the protection of the pigment ink layer 25, the transparent layer 26 allows the image surface from being peeled or damaged by an external force (e.g., contact with a nail), thus providing the image with an improved abrasion resistance.

Japanese Patent No. 3190535 discloses a method for using a printing head that can eject a processing liquid different from an ink in a multipath printing apparatus in which a plurality of scannings of a printing head that can eject the ink are performed to print an image on a predetermined area on a printing medium. For example, the processing liquid includes a cationic substance and forms a transparent ink layer different from an ink layer formed by an anionic dye ink. Specifically, after the application of the dye ink, the processing liquid is applied to form the transparent ink layer for improving the water resistance of the ink layer of the dye ink. Japanese Patent No. 3190535 also discloses a configuration, in the multipath printing apparatus, to apply the processing liquid in a final scanning of the printing head on the basis of processing liquid ejection data that is generated so as to apply the processing liquid to a position on the printing medium to which the ink is applied.

Covering the outermost surface of an image printed by an ink on a printing medium by a transparent layer is very effective to improve an image performance such as the abrasion resistance. However, in order to apply the processing liquid to the entire surface of an image printed by pigment inks of a plurality of colors, a relatively great amount of the processing liquid is required when compared to the amount of each color of the pigment ink. This has caused problems such as an ink tank for the processing liquid having a larger size and an increased running cost due to an increased consumption of the processing liquid for example.

As disclosed in Japanese Patent No. 3190535, when the processing liquid is applied only in the final scanning of the printing head, a great amount of the processing liquid is applied to the printing medium in the final scanning. Since a total amount of ink that can be absorbed by the printing medium at one time is limited, the processing liquid may be applied in the final scanning in an amount exceeding the limit. When the amount of the applied processing liquid exceeds the total amount of ink that can be absorbed by the printing medium at one time, the excessive ink may cause problems in the image performance such as a flooded ink phenomenon, bleeding, beading, defective drying, and a interference pattern phenomenon due to the transparent layer 26 finished to have a mirror surface.

When the multipath printing apparatus is structured so that the processing liquid is applied through the printing head for ejecting the processing liquid only in the final scanning, the printing head is driven in a concentrated manner in the final scanning. Specifically, among a plurality of ejection openings existing in the printing head, part of the ejection openings are used for the final scanning to eject the processing liquid in a concentrated manner. Thus, part of the plurality of ejection openings of the printing head for ejecting the processing liquid may have a deteriorated durability.

When the final scanning for applying the processing liquid is added separately from a scanning for printing an image, the printing apparatus must perform an increased number of scannings, thus deteriorating the printing speed (throughput) when compared with a case where no processing liquid is applied.

SUMMARY OF THE INVENTION

The present invention provides an ink jet printing apparatus, an ink jet printing method, a data generation apparatus, a computer program, and an ink jet printing system by which a timing for ejecting a processing liquid can be changed to improve an image performance such as abrasion resistance, to provide the printing head with a longer life, and to improve the throughput.

In the first aspect of the present invention, there is provided an ink jet printing apparatus in which a printing head that can eject an ink and a processing liquid from a plurality of ejection openings forming an ejection opening array is subjected to a plurality of scannings to a predetermined area on a printing medium to form an image by the ink on the printing medium and to cover the formed image by the processing liquid, comprising: a generation unit that generates processing liquid ejection data with regards to the predetermined area for which the formation of the image is completed, the processing liquid ejection data being for ejecting the processing liquid from the printing head in a plurality of scannings of the printing head; a control unit that changes, in accordance with the processing liquid ejection data for a final scanning for ejecting only the processing liquid among the processing liquid ejection data generated by the generation unit, a region per one scanning of the printing head within which the ejection opening array of the printing head is used to form the image and to cover the formed image; and an ejection unit that causes the printing head to eject the processing liquid based on the processing liquid ejection data generated by the generation unit, wherein: the generation unit generates different processing liquid ejection data depending on the change by the control unit.

In the second aspect of the present invention, there is provided an ink jet printing method by which a printing head that can eject an ink and a processing liquid from a plurality of ejection openings forming an ejection opening array is subjected to a plurality of scannings to a predetermined area on a printing medium to form an image by the ink on the printing medium and to cover the formed image by the processing liquid, comprising: a generation step for generating processing liquid ejection data with regards to the predetermined area for which the formation of the image is completed, the processing liquid ejection data being for ejecting the processing liquid from the printing head in a plurality of scannings of the printing head; a control step for changing, in accordance with the processing liquid ejection data for a final scanning for ejecting only the processing liquid among the processing liquid ejection data generated by the generation step, a region per one scanning of the printing head within which the ejection opening array of the printing head is used to form the image and to cover the formed image; and an ejection step for causing the printing head to eject the processing liquid based on the processing liquid ejection data generated by the generation step, wherein the generation step generates different processing liquid ejection data depending on the change by the control step.

In the third aspect of the present invention, there is provided a data generation apparatus for generating ejection data for ejecting, from a printing head, a processing liquid for covering a printing medium and an image formed by an ink on the printing medium, comprising a generation unit that generates processing liquid ejection data for ejecting, to a predetermined area on the printing medium for which a formation of the image by the ink is completed, the processing liquid from the printing head in a plurality of scannings of the printing head.

In the fourth aspect of the present invention, there is provided a computer program for generating ejection data for ejecting, from a plurality of ejection openings forming an ejection opening array of a printing head, a processing liquid for covering a printing medium and an image formed by an ink on the printing medium, the computer program making a computer executing: a generation step of generating processing liquid ejection data with regards to a predetermined area on the printing medium for which a formation of the image is completed, the processing liquid ejection data being for ejecting the processing liquid from the printing head in a plurality of scannings of the printing head; and a control step of changing, in accordance with the processing liquid ejection data for a final scanning for ejecting only the processing liquid among the processing liquid ejection data, a range per one scanning of the printing head within which the ejection opening array of the printing head is used to form the image and to cover the formed image, wherein the generation step generates different processing liquid ejection data depending on the change by the control step.

In the fifth aspect of the present invention, there is provided an ink jet printing system, comprising: an ink jet printing apparatus in which a printing head that can eject an ink and a processing liquid is subjected to a plurality of scannings to a predetermined area on a printing medium to form an image by the ink on the printing medium and to cover the formed image by the processing liquid; and a data supply apparatus for supplying data to the ink jet printing apparatus, wherein the data supply apparatus includes: a generation unit that generates processing liquid ejection data with regards to a predetermined area for which a formation of the image is completed, the processing liquid ejection data being for ejecting the processing liquid from the printing head in a plurality of scannings of the printing head; and a supply unit that supplies the processing liquid ejection data generated by the generation unit to the ink jet printing apparatus.

According to the present invention, a processing liquid is ejected by a plurality of scannings of a printing head to a predetermined region already subjected to an image formation by an ink. Thus, ejection timings of the processing liquid can be carried out at two or more scannings. As a result, the drying of the processing liquid ejected to the printing medium can be promoted while improving the image performance of the image by the processing liquid (e.g., abrasion resistance) to prevent flooded ink, thus achieving the printing of a high-quality image. Furthermore, ejection timings of the processing liquid carried out at two or more scannings can expand an area of the printing head used to eject the processing liquid, thus improving the durability of the printing head.

Furthermore, in accordance with ejection data for ejecting the processing liquid in the final scanning, in which only the processing liquid is ejected, among ejection data for ejecting the processing liquid, an area within which the ejection opening array of the printing head is used to form an image and to cover the formed image by one scanning of the printing head can be expanded to improve the throughput. The area of the printing head used to eject ink also can be expanded to provide the printing head with improved durability.

Further features of the present invention will become apparent from the following description of exemplary embodiments with reference to the attached drawings.

BRIEF DESCRIPTION OF THE DRAWINGS

FIG. 10A to FIG. 10D illustrate the ejection data for cyan ink and magenta ink in the first scanning to the fourth scanning in FIG. 5, respectively;

FIG. 11 illustrates scanning numbers at the completion of the image formation corresponding to the ejection data of FIG. 10A to FIG. 10D;

FIG. 12 illustrates the data obtained by adding "1" to the values of FIG. 11;

FIG. 13 illustrates the data obtained by calculating the logical sum of the ejection pattern of FIG. 6 and the data of FIG. 12;

DESCRIPTION OF THE EMBODIMENTS

In this specification, the term "processing liquid" means a liquid (image performance-improving liquid) that is caused to a contact with an ink to improve the image performance such as image toughness or image quality. The expression of "improve the image performance" herein means to improve at least one of the abrasion resistance, the weather resistance, the water resistance, and the alkali resistance to improve the toughness of an image formed by the ink. On the other hand, the expression of "to improve the image quality" means to improve at least one of the glossiness, the haze characteristic, and the bronze characteristic to improve the quality of an image formed by the ink. In this embodiment, a processing liquid that improves the abrasion resistance among the image toughnesses will be exemplarily described.

The following section will describe preferred embodiments of the present invention with reference to the drawings.

First Embodiment

FIG. 1 to FIG. 17 illustrate the first embodiment of the present invention. The following section will describe the first embodiment in an order of items of (the entire configuration), (compositions of ink and processing liquid), (printing operation: the first printing method), (configuration example of image processing system), (method for generating processing liquid ejection data), (printing operation: the second printing method), and (relation between the first and second printing methods).

(Entire Configuration)

Figure 1:
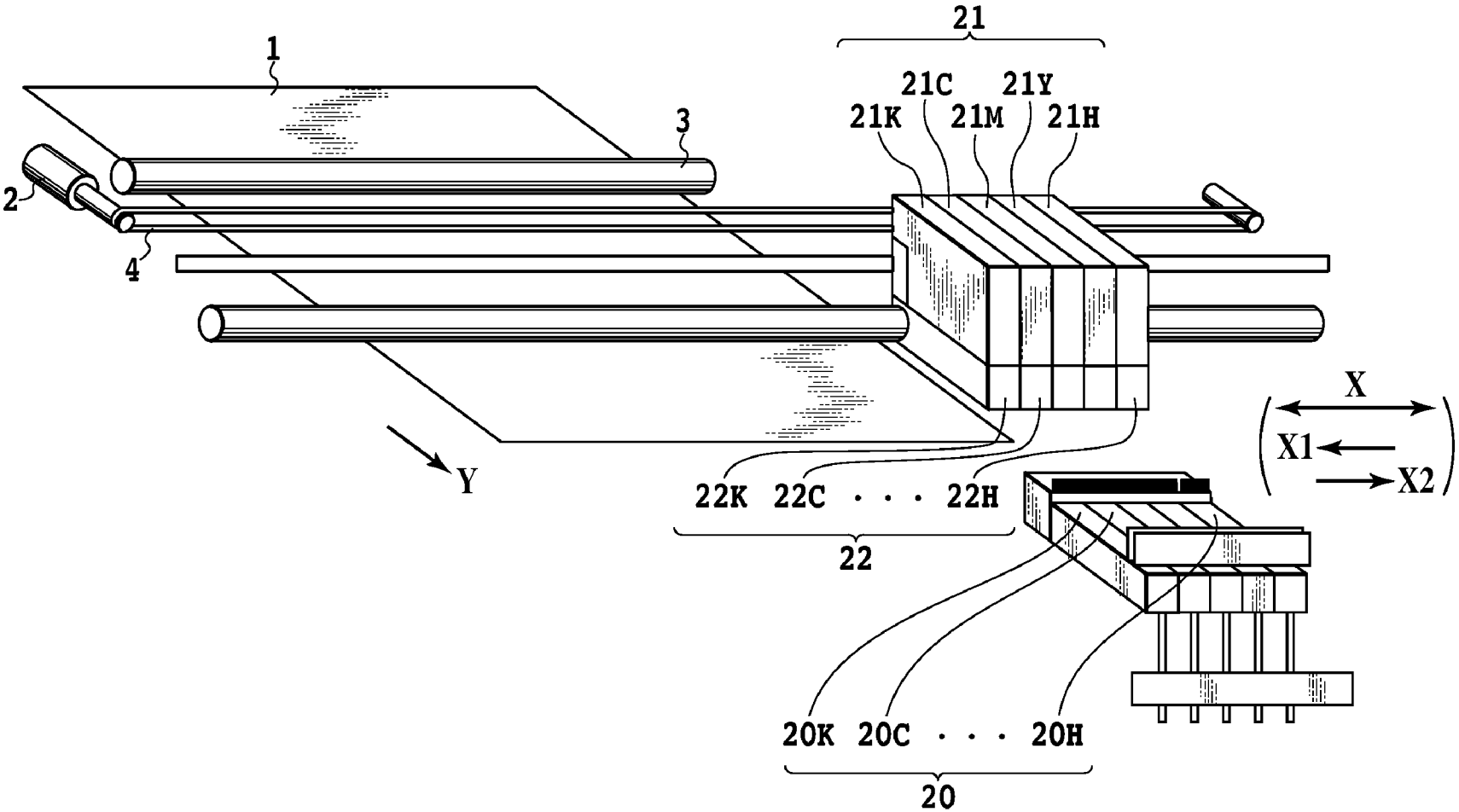
FIG. 1 is a perspective view illustrating the main part of an ink jet printing apparatus of a first embodiment of the present invention.

FIG. 1 is a perspective view illustrating a main part of an ink jet printing apparatus of this embodiment. A printing head 22 has a printing head for a color pigment ink and printing head for a processing liquid. These printing heads include ejection openings through which the color pigment ink and the processing liquid are ejected to a printing medium 1 to carry out a printing operation. The printing head 22 has five printing heads 22K, 22C, 22M, 22Y, and 22H through which color pigment inks of black (K), cyan (C), magenta (M), and yellow (Y) and a processing liquid (H) are ejected, respectively. An ink tank 21 has five ink tanks 21K, 21C, 21M, 21Y, and 21H for storing the inks of correcting colors and the processing liquid to be supplied to the respective printing heads 22K, 22C, 22M, 22Y, and 22H. The printing head 22 and the ink tank 21 can be moved in the main scanning direction (direction shown by the arrow X).

A cap 20 has five caps 20K, 20C, 20M, 20Y and 20H for capping ink ejection faces of the respective seven printing heads. When a printing operation is not performed, the printing head 22 and the ink tank 21 are returned to a home position where the cap 20 is provided and wait until a predetermined time passes. When the predetermined time has passed, the printing head 22 is capped in order to prevent the ink ejection face of the printing head 22 (face including the ejection openings) from being dried.

It is noted that, when each of these printing head or the ink tanks is individually described, the reference numeral given to the component is used. However, when these components are described collectively, the printing head is denoted with a generic reference numeral 22, the ink tank is denoted with a generic reference numeral 21, and the cap is denoted with a generic reference numeral 20.

In this example, the printing heads and the ink tanks constitute, in an integrated or separatable manner, a head cartridge. The head cartridge is detachably mounted on a carriage (not shown). The printing heads and the ink tanks also may be separately provided on the carriage without constituting the head cartridge.

The carriage is guided so as to be movable along the main scanning direction shown by the arrow X and caused by a carriage motor 2 to reciprocate via a belt 4 in the main scanning direction. The printing medium 1 is transported by a transportation roller in the sub-scanning direction (direction shown by the arrow Y) crossing (in this example, orthogonal to) the main scanning direction.

Figure 2:
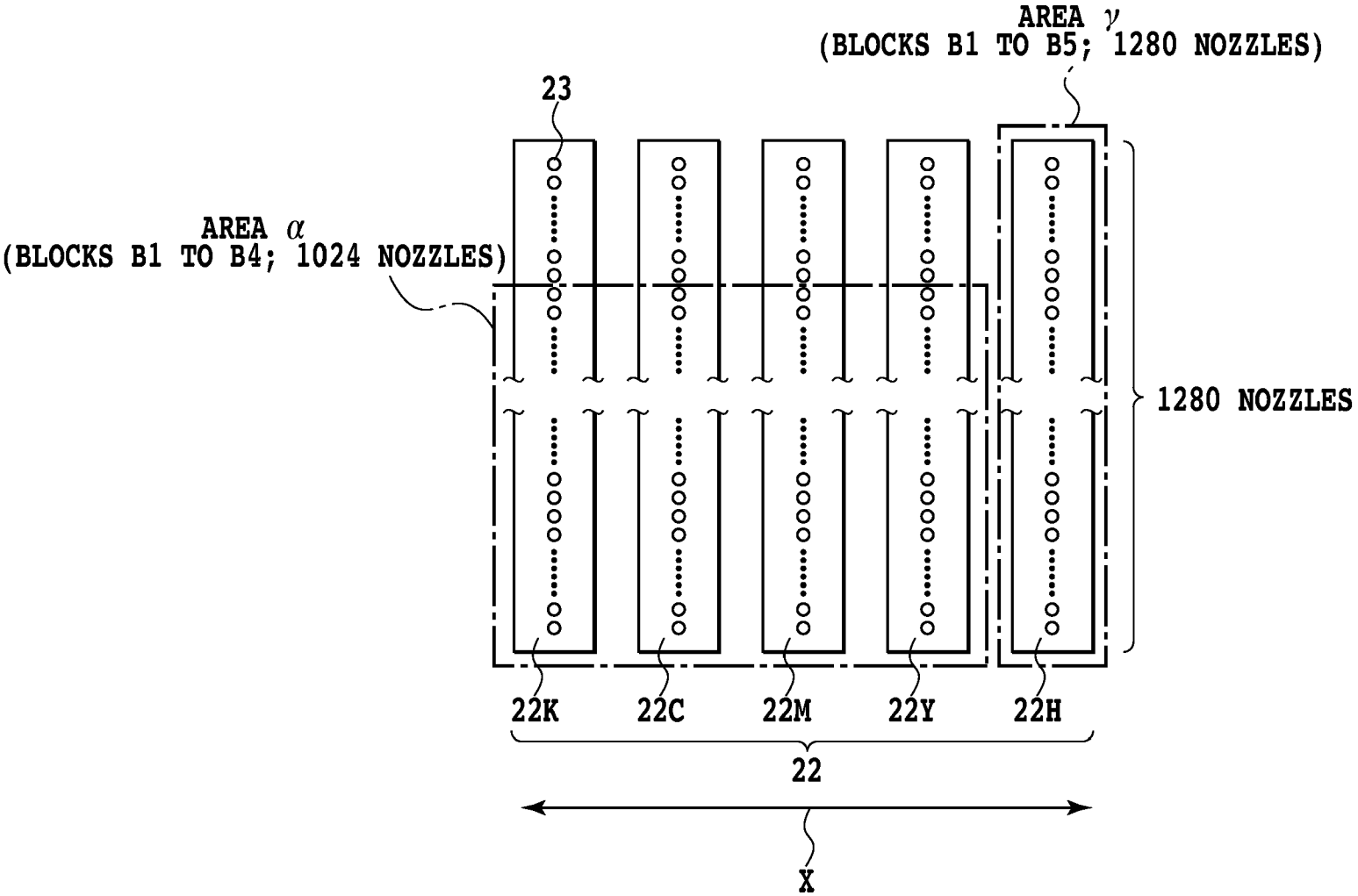
FIG. 2 illustrates a printing head used in the first embodiment seen from the ejection opening side.

FIG. 2 illustrates the printing head 22 seen from the ejection opening side. The printing heads 20K, 20C, 20M, 20Y, and 20H of this example include 1280 ejection openings 23 forming nozzles that are arranged with a density of 1200 dpi in the sub-scanning direction (direction shown by the arrow Y) crossing (in this example, orthogonal to) the main scanning direction. Each of ejection openings 23 ejects the inks at one time in an amount of about 4 ng. In this embodiment, the printing heads for ejecting the pigment ink and the printing head for ejecting the processing liquid have the same configuration.

(Compositions of Ink and Processing Liquid)

Next, compositions the pigment ink and the processing liquid used in this embodiment will be described.

(Yellow Ink)

(1) Preparation of Dispersion Liquid

First, polymer aqueous solution of styrene/butylacrylate/acrylic acid copolymer ((copolymer ratio (weight ratio)=30/40/30), acid value of 202, weight-average molecular weight of 6500, and solid content of 10%) was neutralized by potassium hydroxide. The above polymer aqueous solution of 30 parts, pigment [C.I. pigment yellow 74 (product name: Hansa Brilliant Yellow 5GX (made by Clariant Co.))] of 10 parts, and ion-exchanged water of 60 parts were mixed and were mechanically agitated. Next, the above material was placed in a batch-type vertical sand mill (made by Aimex Co.) to fill zirconia beads having a diameter of 0.3 mm of 150 parts to the sand mill. Then, the material was subjected to a dispersion processing for 12 hours while being cooled by water. Then, this dispersion liquid was placed in a centrifuge separator to remove large particles. Then, the final prepared matter of yellow pigment dispersion was obtained that had a solid content of about 12.5% and a weight average particle diameter of 120 nm.

(2) Preparation of Ink

A yellow ink was prepared by mixing the above yellow pigment dispersion element with the following components to sufficiently agitate the resultant mixture to subject the mixture to pressurization and filtering by a micro filter having pore size of 1.0 μm (made by FUJI FILM Co.) to prepare the ink.

The above yellow pigment dispersion element of 40 parts
Glycerin of 9 parts
Ethylene glycol of 6 parts
Acetylene glycol ethylene oxide addition product (article name: Acetyrenol EH) of 1 part
1,2-hexanediol of 3 parts
Polyethylene glycol (molecular weight of 1000) of 4 parts
Ion-exchanged water of 37 parts (Magenta Ink)

(1) Preparation of Dispersion Liquid

First, benzyl acrylate and methacrylic acid were used as raw material to use the common procedure to prepare an AB-type block polymer having an acid value of 300 and a number average molecular weight of 2500. The AB-type block polymer was neutralized by potassium hydroxide aqueous solution and was diluted by ion-exchanged water to obtain homogeneous polymer aqueous solution of 50 mass %. The above polymer solution of 100 g and C.I. pigment red 122 of 100 g was mixed with ion-exchanged water of 300 g and the resultant mixture was mechanically agitated for 0.5 hours. Next, a microfluidizer was used to send the above mixture through an interaction chamber five times under a fluid pressure of about 70 MPa. Then, this dispersion liquid was subjected to a centrifugal separation processing to remove large particles. As a result, the final prepared matter of magenta dispersion liquid was obtained that had a pigment concentration of 10 mass % and a dispersant concentration of 5 mass %.

(2) Preparation of Ink

A magenta ink was prepared by mixing the above magenta dispersion liquid with the following components to sufficiently agitate the resultant mixture. Then, a micro filter (made by FUJI FILM Co.) having a pore size of 2.5 μm was used to subject the mixture to pressurization and filtering to prepare the ink having a pigment concentration of 4 mass % and a dispersant concentration of 2 mass %.

The above magenta dispersion liquid of 40 parts
Glycerin of 10 parts
Diethylene glycol of 10 parts
Acetylene glycol EO addition product of 0.5 parts
Ion-exchanged water of 39.5 parts (Cyan Ink)

(1) Preparation of Dispersion Liquid

First, benzyl acrylate and methacrylic acid were used as raw material to use the common procedure to prepare an AB-type block polymer having an acid value of 250 and a number average molecular weight of 3000. The AB-type block polymer was neutralized by potassium hydroxide aqueous solution and was diluted by ion-exchanged water to obtain homogeneous polymer aqueous solution of 50 mass %. Then, the above polymer solution of 180 g was mixed with C.I. pigment blue 15:3 of 100 g and ion-exchanged water of 220 g and the mixture was mechanically agitated for 0.5 hours. Next, a micro fluidizer was used to send the above mixture through an interaction chamber five times under a fluid pressure of about 70 MPa. Then, this dispersion liquid was subjected to a centrifugal separation processing to remove large particles. As a result, the final prepared matter of cyan dispersion liquid was obtained that had a pigment concentration of 10 mass % and a dispersant concentration of 10 mass %.

(2) Preparation of Ink

A cyan ink was prepared by mixing the above cyan dispersion liquid with the following components to sufficiently agitate the resultant mixture. Then, a micro filter (made by FUJI FILM Co.) having a pore size of 2.5 μm was used to subject the mixture to pressurization and filtering to prepare the ink having a pigment concentration of 2 mass % and a dispersant concentration of 3 mass %.

The above cyan dispersion liquid of 20 parts
Glycerin of 10 parts
Diethylene glycol of 10 parts
Acetylene glycol EO addition product of 0.5 parts
Ion-exchanged water of 53.5 parts (Black Ink)

(1) Preparation of Dispersion Liquid

Polymer aqueous solution used for the yellow ink of 100 g, carbon black of 100 g, and ion-exchanged water of 300 g were mixed and the mixture was mechanically agitated for 0.5 hours. Next, a microfluidizer was used to send this mixture through an interaction chamber 5 times under a fluid pressure of about 70 MPa. Then, this dispersion liquid was subjected to a centrifugal separation processing to remove large particles. As a result, the final prepared matter of black dispersion liquid was obtained that had a pigment concentration of 10 mass % and a dispersant concentration of 6 mass %.

(2) Preparation of Ink

A black ink was prepared by mixing the above black dispersion liquid with the following components to sufficiently agitate the resultant mixture. Then, a micro filter (made by FUJI FILM Co.) having a pore size of 2.5 μm was used to subject the mixture to pressurization and filtering to prepare the ink having a pigment concentration of 5 mass % and a dispersant concentration of 3 mass %.

The above black dispersion liquid of 50 parts
Glycerin of 10 parts
Triethylene glycol of 10 parts
Acetylene glycol EO addition product of 0.5 parts
Ion-exchanged water of 25.5 parts (Processing Liquid)

(1) Preparation of Processing Liquid

The following components were mixed and the mixture was sufficiently agitated to prepare a processing liquid.

Commercially-available acryl silicone copolymer (article name: Simac US-4501 made by TOAGOSEI Co.) of 5 parts
Glycerin of 5 parts
Ethylene glycol of 15 parts
Acetylene glycol ethylene oxide addition product (article name: Acetyrenol EH) of 0.5 parts
Ion-exchanged water of 74.5 parts It is important that the processing liquid of this embodiment includes transparent resin material for the purpose of forming a transparent layer on the outermost surface of an image to improve the abrasion resistance. Such transparent resin material may be transparent resin material copolymerized with a polydimethylsiloxane component. The use of this can provide a slipping property to efficiently reduce the dynamic friction coefficient. In this embodiment, transparent resin material copolymerized with a commercially-available polydimethylsiloxane component (the above-described acryl silicone copolymer: Simac US-450) is used. This processing liquid also may be referred as coat ink, surface coat ink, clear ink, or reaction liquid.

Figure 19:
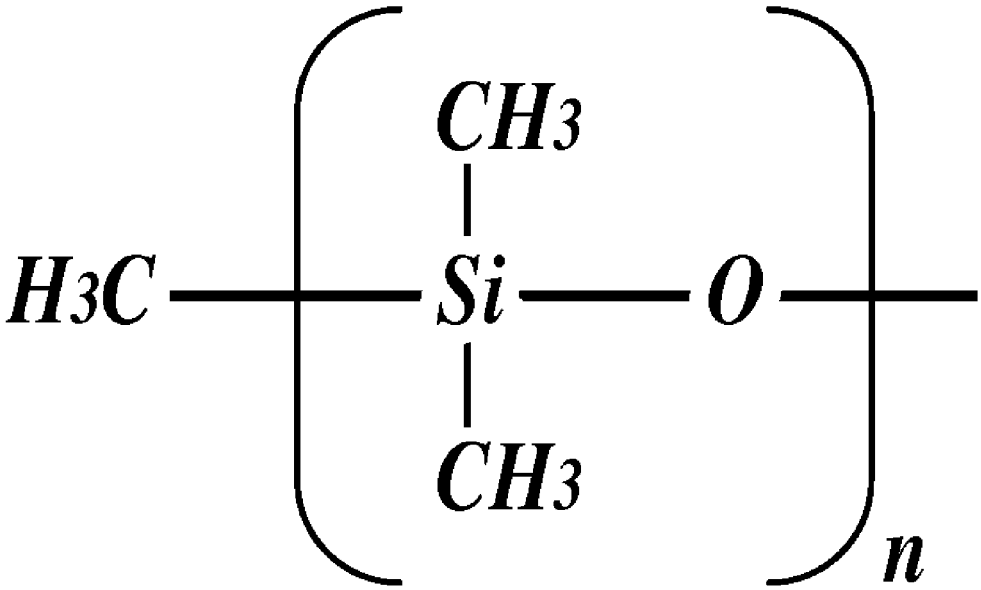
FIG. 19 is a schematic diagram illustrating a chemical structure of a polydimethylsiloxane component used for the processing liquid.

FIG. 19 is a schematic diagram illustrating a general polydimethylsiloxane component. A polydimethylsiloxane component is structured so that a siloxane bonded chain of (Si—O—Si) is surrounded by methyl groups (—CH3) and thus has amolecular structure having a low polarity. Thus, a polydimethylsiloxane-base compound has a property according to which the compound moves to the surface of the transparent layer formed by the processing liquid used in this embodiment or the interface to localize at the surface, and localizes in the surface or the the interface, and the neighborhood thereof. As a result, the transparent layer has a reduced surface energy to reduce the affinity between the transparent layer and a nail of a human. Thus, it is considered that the dynamic friction coefficient to dynamic friction coefficient can be remarkably reduced.

Another transparent resin material providing the slipping property may be the one obtained by adding silicone oil to acryl-base resin. However, any resin material also may be used so long as the material can be used to form the transparent layer on the outermost surface of the pigment ink layer to reduce the dynamic friction coefficient.

(Printing Operation)

Next, the printing operation in this embodiment will be described. In this example, the first and second printing methods are used selectively. The first printing method is a multipath printing method according to which an image layer of the ink and a transparent layer of the processing liquid are formed for each one pixel (or for each predetermined area) through five scannings. The second printing method is a multipath printing method according to which the image layer of the ink and the transparent layer of the processing liquid are formed for each one pixel (or for each predetermined area) through four scannings. The second printing method will be described later.

In the first printing method, the respective colors of inks (cyan (C), magenta (M), yellow (Y), and black (K)) are ejected through four scannings to print an image in the predetermined arean and the processing liquid is ejected through the four scannings and the subsequent fifth scanning to form the transparent layer. In order to simplify the description of the printing operation in the following section, it is assumed that only cyan (C) ink and magenta (M) ink are used to print an image.

(First Printing Method)

Figure 5:
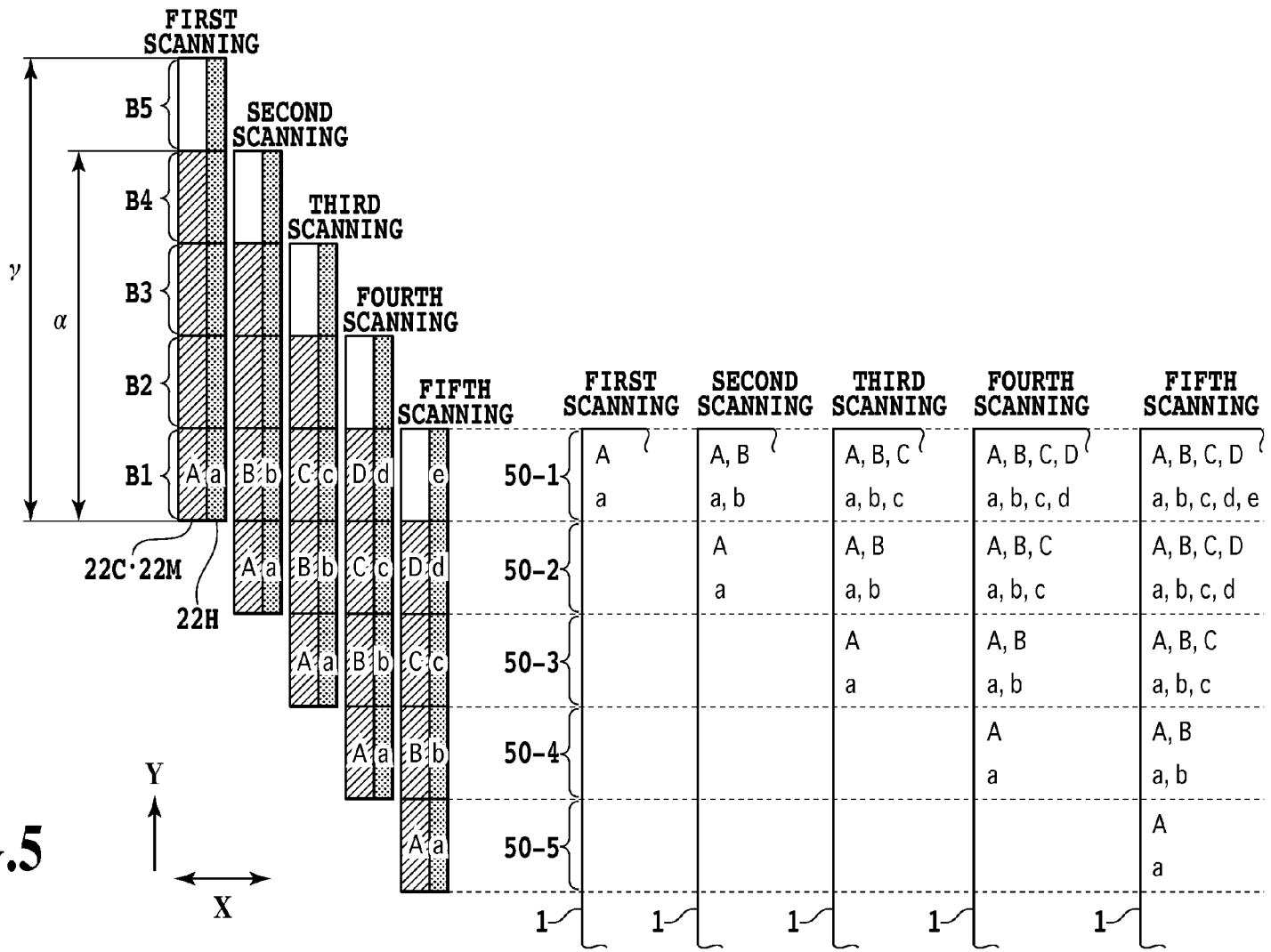
FIG. 5 illustrates a printing method in the first embodiment of the present invention.

FIG. 5 illustrates the first printing method. The printing heads 22C and 22M for ejecting cyan (C) ink, and magenta (M) ink and the printing head 22H for ejecting the processing liquid are divided to five blocks B1, B2, B3, B4, and B5 that have the total of 1280 ejection openings divided to 256 ejection openings, respectively. In the printing heads 22C and 22M, 1024 ejection openings in an area α from blocks B1 to B4 (see FIG. 2) are used. In the following description, the ejection openings of these blocks B1 to B4 are also called as ejection openings of regions A, B, C, and D. In the printing head 22H, 1280 ejection openings in an area γ of all blocks B1 to B5 (see FIG. 2) are used. In the following description, the ejection openings of these blocks B1 to B5 are also called as the ejection openings of regions a, b, c, d, and e. In FIG. 5, each of 50-1, 50-2, 50-3, . . . and so on denotes a printing region on the printing medium 1 corresponding to one block of the printing head.

First, in the first scanning, based on the ejection data at the first scanning of the printing region 50-1, the ink is ejected through ejection openings of the regions A of the printing heads 22C and 22M. Based on the ejection data of the processing liquid at the first scanning, the processing liquid is ejected through the ejection openings of the region a of the printing head 22H.

Next, the printing medium 1 is transported in the sub-scanning direction (direction shown by the arrow Y) in an amount ⅕ of the length of the printing head. In FIG. 5, the printing head is shown as having a relative movement in the opposite direction to the sub-scanning direction. In the subsequent second scanning, based on the ejection data at the second scanning of the printing region 50-1, the ink is ejected through the ejection openings of the region B of the printing heads 22C and 22M. Based on the ejection data for the processing liquid at the second scanning, the processing liquid is ejected through the ejection openings of the region b of the printing head 22H. In this second scanning, the printing region 50-2 is subjected to the first scanning.

Next, the printing medium 1 is transported in the sub-scanning direction in an amount ⅕ of the length of the printing head. In the subsequent third scanning, based on the ejection data at the third scanning of the printing region 50-1, the ink is ejected through the ejection openings of the region C of the printing heads 22C and 22M. Based on the ejection data for the processing liquid at the third scanning, the processing liquid is ejected through the ejection openings of the region c of the printing head 22H. In this third scanning, the second scanning to the printing region 50-2 and the first scanning to the printing region 50-3 are performed.

Next, the printing medium 1 is transported in the sub-scanning direction in an amount ⅕ of the length of the printing head. In the subsequent fourth scanning, based on the ejection data at the fourth scanning of the printing region 50-1, the ink is ejected through the ejection openings of the region D of the printing heads 22C and 22M. Based on the ejection data for the processing liquid at the fourth scanning, the processing liquid is ejected through the ejection openings of the region d of the printing head 22H. In this fourth scanning, the third scanning to printing region 50-2, the second scanning to the printing region 50-3, and the first scanning to the printing region 50-4 are performed.

Through the first to fourth scannings, the printing of the image on the printing region 50-1 by the cyan (C) ink and magenta (M) ink is completed.

Next, the printing medium 1 is transported in the sub-scanning direction in an amount ⅕ of the length of the printing head. In the subsequent fifth scanning, based on the ejection data for the processing liquid at the fifth scanning, the processing liquid is ejected through the ejection openings of the region e of the printing head 22H. As a result, the application of the processing liquid to the printing region 50-1 (i.e., the formation of the transparent layer 26) is completed. In this fifth scanning, the fourth scanning to the printing region 50-2, the third scanning to the printing region 50-3, the second scanning to the printing region 50-4, and the first scanning to the printing region 50-5 are performed.

Thereafter, the similar scanning is repeated to consecutively complete the printing of the image to the printing regions 50-2 and 50-3, . . . and so on and the formation of the transparent layer 26.

Figure 20A:
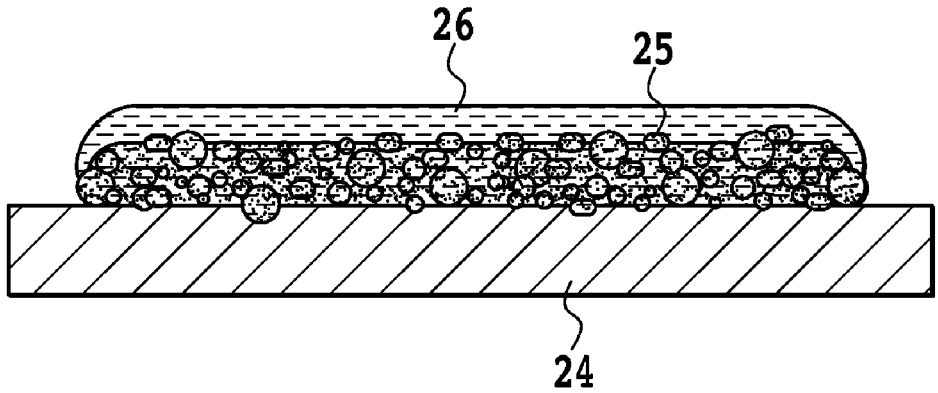
FIG. 20A is a schematic cross-sectional view of a printed image when a pigment ink is used to print an image on a printing medium having thereon an ink absorbing layer.
Figure 20B:
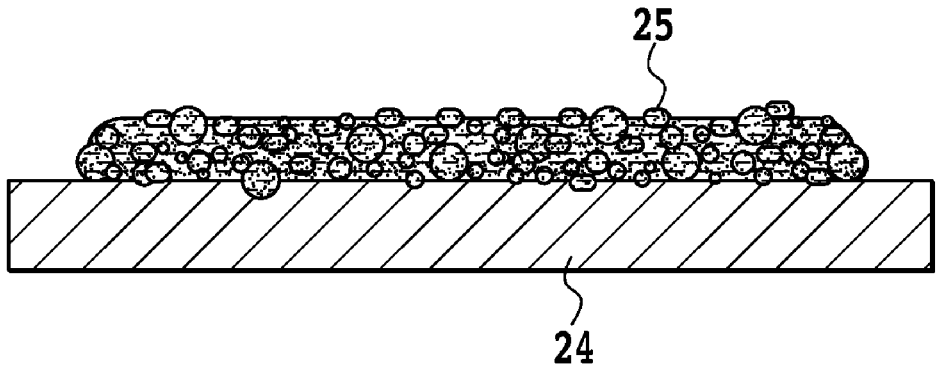
FIG. 20B is a schematic cross-sectional view of a printed image in which the processing liquid is used to form a transparent layer on the outermost surface.

When a pigment ink is used to form an image on a glossy paper, as described above with reference to FIG. 20A, coloring pigment particles cannot enter the interior of the ink absorbing layer 24 and the pigment ink layer 25 is formed on the surface of the ink absorbing layer 24. Thus, when an external force is directly applied to the pigment ink layer 25, the image surface is easily damaged to cause a case where the pigment ink layer 25 may be peeled. In an actual usage environment, for example, in a handling process where the printing medium is rolled or is adhered to a wall, when the printing medium has a contact with a nail, the image is significantly damaged and the pigment ink layer 25 may be completely peeled from the ink absorbing layer 24 in some cases. On the other hand, when the processing liquid is used to form the transparent layer 26 so as to cover the outermost surface of the pigment ink layer 25 as shown in FIG. 20B, the pigment ink layer does not have a direct contact with a nail or the like, thus suppressing the pigment ink layer from being peeled. The direct protection of the pigment ink layer as described above is very effective to improve the abrasion resistance.

(Configuration Example of Image Processing System)

Figure 3:
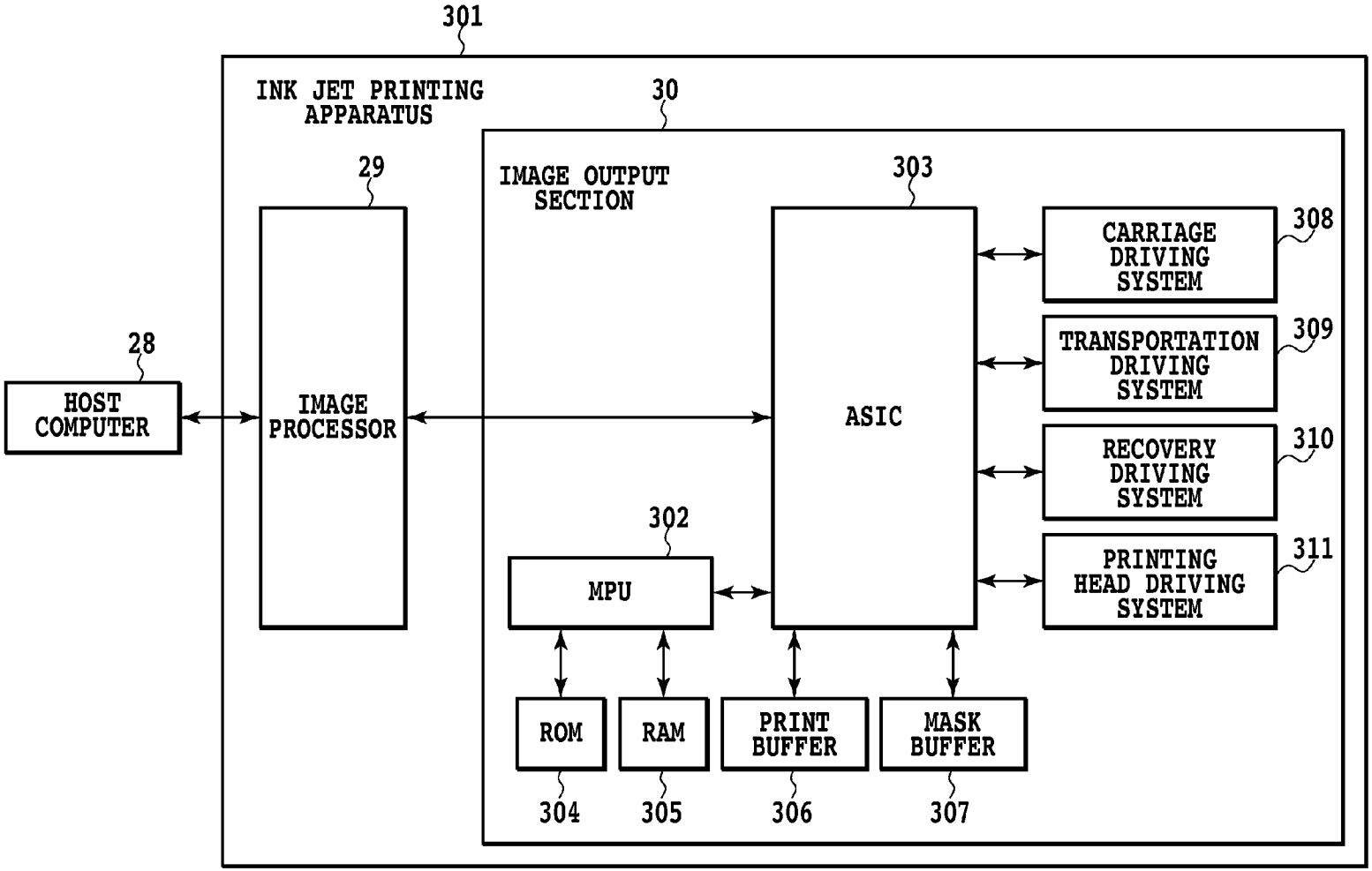
FIG. 3 is a block diagram illustrating a control system in an ink jet printing apparatus that is a representative embodiment of the present invention.

FIG. 3 is a block diagram illustrating the control system in an ink jet apparatus that is a representative embodiment of the present invention. A host computer (image input section) 28 sends multivalued image data stored in various storage media such as a hard disk to an image processor 29 in an ink jet printing apparatus 301. The multivalued image data also can be sent from an image input device connected to the host computer 28 (e.g., scanner, digital camera). The image processor 29 subjects the inputted multivalued image data to an image processing (which will be described later) to convert the data to binary image data. As a result, binary image data (ink ejection data) for ejecting a plurality of types of pigment inks through a printing head (ink ejection data) is generated. Binary image data for ejecting the processing liquid (processing liquid ejection data) is also generated. Based on binary image data for at least two types or more pigment inks and the processing liquid sent from the image processor 29, an image output section 30 applies the pigment ink and the processing liquid to the printing medium to print an image thereon.

The image output section 30 itself is controlled by a Micro Processor Unit (MPU) 302 based on a program stored in an ROM 304. An RAM 305 is used as an operation area or a temporary data storage area of the MPU 302. The MPU 302 controls, via an ASIC 303, a carriage driving system 308, a printing medium transportation driving system 309, a printing head recovery driving system 310, and a printing head driving system 311. The MPU 302 is structured so as to read data from and write data to a print buffer 306 via the ASIC 303.

The print buffer 306 temporarily stores image data converted to a format by which the data can be transferred to the printing head. A mask buffer 307 temporarily stores a predetermined mask pattern for optionally subjecting the data transferred from the print buffer 306 to the printing head to an AND processing. It is noted the plurality of sets of mask patterns for a plurality of multi-path printings having different numbers of paths are prepared in the ROM 304. In an actual printing, the applicable mask pattern is read from the ROM 304 and is stored in the mask buffer 307.

(Method of Generating Ejection Data for Processing Liquid)

Figure 4:
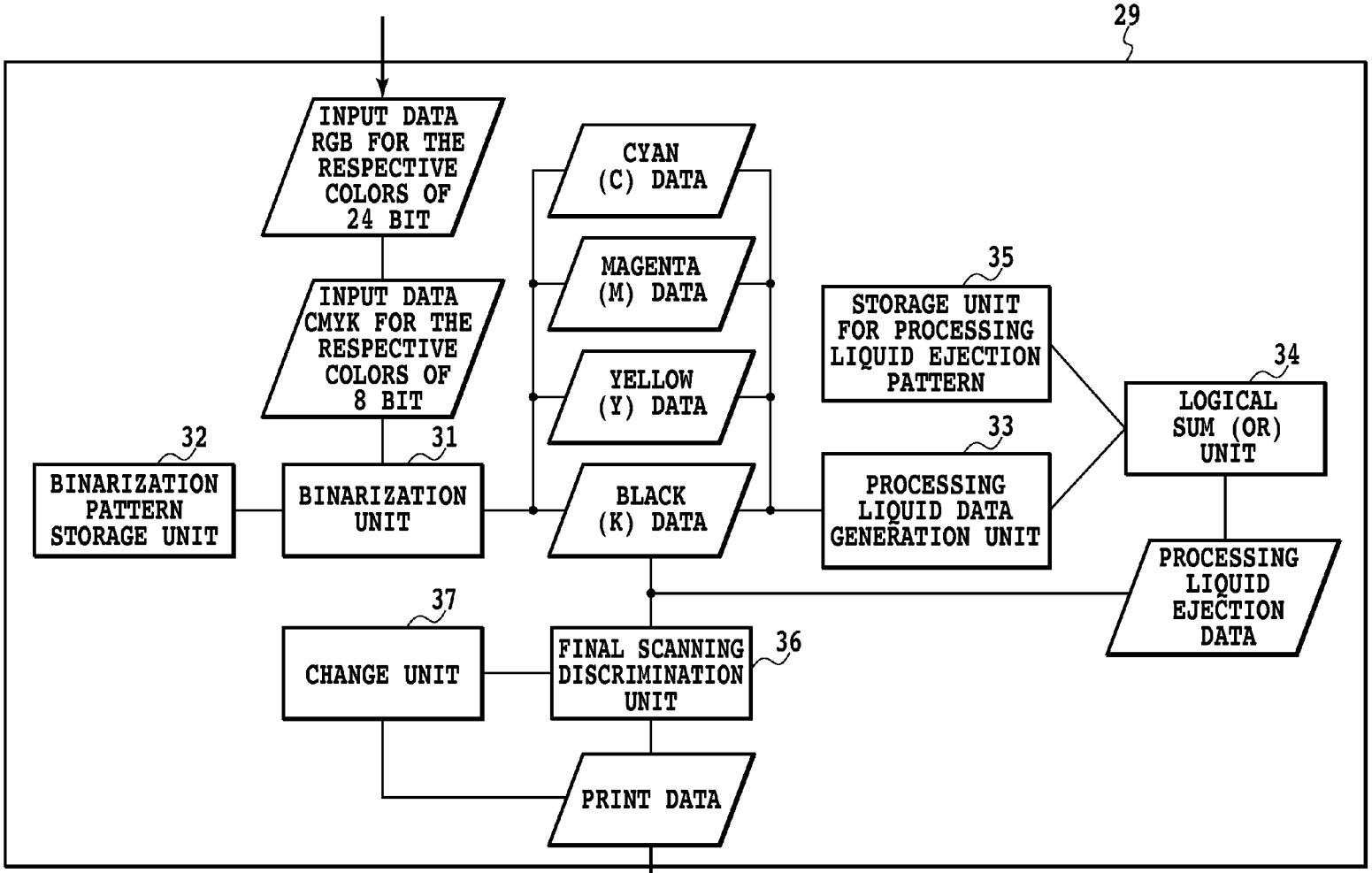
FIG. 4 is a block diagram illustrating an image processor in FIG. 3.

Next, a method of generating the ejection data for the processing liquid in this embodiment will be described with reference to FIG. 4. FIG. 4 is a block diagram illustrating the image processor 29 of FIG. 3. This image processor 29 generates ejection data for the pigment ink and generates ejection data for the processing liquid based on the ejection data for the pigment ink.

Specifically, first, RGB-type multivalued image data is inputted through the image input section 28. Next, the RGB-type multivalued image data is converted to multivalued image data corresponding to the respective plurality of types of the inks (K, C, M, and Y) used for the printing of an image. Next, a binarization unit 31 develops, based on the pattern stored in the binarization pattern storage unit 32, multivalued image data corresponding to the respective types of the inks to binary bit map data corresponding to the respective types of the inks. As a result, binary image data (ink ejection data) for applying the respective plurality of types of the pigment inks is generated.

The processing liquid ejection data for applying the processing liquid is generated based on the binary image data for the plurality of types of the pigment inks (ink ejection data) thus generated. This processing liquid ejection data is generated by a processing liquid pattern storage unit 35, a processing liquid data generation unit 33, and a logical sum computation processing unit (OR circuit) 34.

Figures 6, 7:
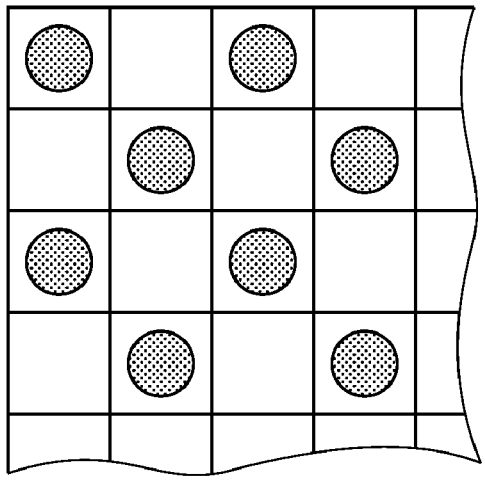
FIG. 6 illustrates a processing liquid mask pattern stored in a processing liquid pattern storage means of FIG. 4.
FIG. 7 illustrates the arrangement of dots formed by cyan ink and magenta ink.
Figure 8A:
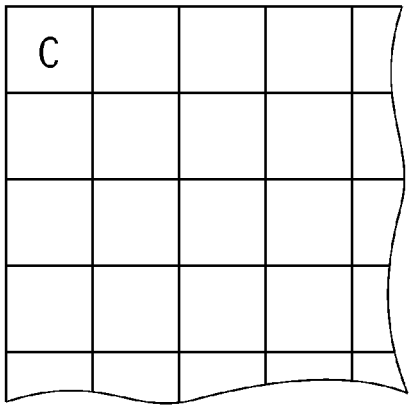
FIG. 8A to FIG. 8D illustrate the ejection data for cyan ink in the first scanning to the fourth scanning in FIG. 5, respectively.
Figure 8B:
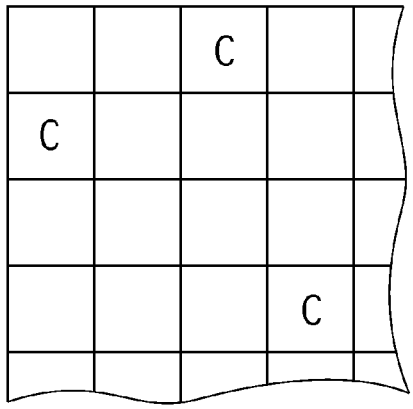
Figure 8C:
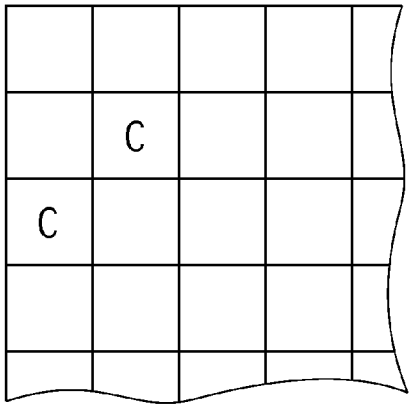
Figure 8D:
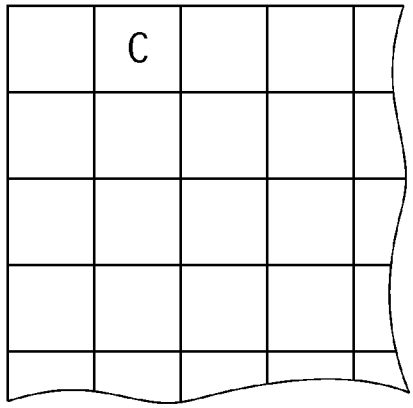
Figure 9A:
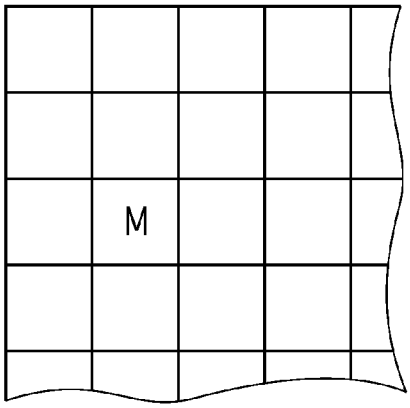
FIG. 9A to FIG. 9D illustrate the ejection data for magenta ink in the first scanning to the fourth scanning in FIG. 5, respectively.
Figure 9B:
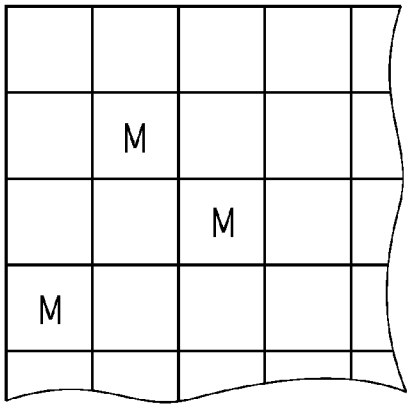
Figure 9C:
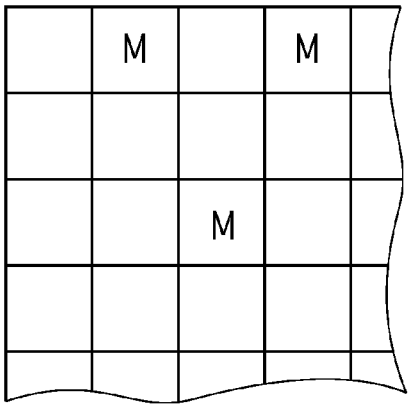
Figure 9D:
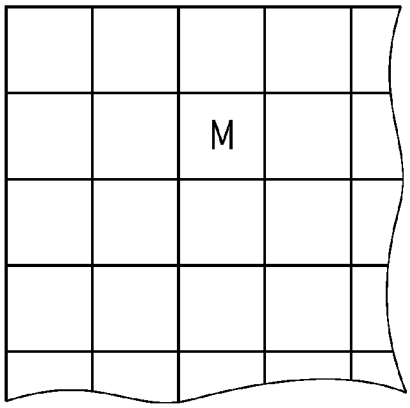

FIG. 6 illustrates a mask pattern for the processing liquid (processing liquid mask pattern) stored in the processing liquid pattern storage unit 35. This processing liquid mask pattern and binary image data for the processing generated based on the binary image data for the plurality of types of the pigment inks (ink ejection data) are subjected to an OR processing to generate thinned-out binary image data for the processing liquid. This processing liquid mask pattern can be used to thin out binary image data for the processing liquid (processing liquid binary image data) generated having a printing duty of 100% in an unit matrix of 4×4 pixels to obtain thinned-out binary image data for the processing liquid (processing liquid thinned-out binary image) having a print duty of 75% (the number of ink ejections (the number of formed ink dots) of 75%.) In the present invention, the entire surface of the pigment ink layer 25 is not always required to be covered by the transparent layer 26 of the processing liquid as shown in FIG. 20B. The pigment ink layer 25 also may be partially covered by the pigment ink layer 25. Specifically, the abrasion resistance can be improved so long as the pigment ink layer is covered by the transparent layer so that the pigment ink layer can be prevented from directly receiving an external force.

In this embodiment, the transparent layer 26 covering about 75% of the ink layer 25 formed by the pigment ink on a glossy paper (printing medium) as shown in FIG. 20B also can suppress an image surface from being peeled or damaged due to the contact with a nail, thus providing a favorable abrasion resistance. Based on the concept as described above, the mask pattern of FIG. 6 for thinning out the processing liquid binary image data with a ratio of 75% is stored as the processing liquid mask pattern. This processing liquid mask pattern also may be a pattern for generating the processing liquid binary image data so that the transparent layer 26 covers 100% of the ink layer 25.

Next, a method for generating the processing liquid ejection data (processing liquid binary image data) will be described by exemplarily describing the method for the cyan (C) and magenta (M) inks among the pigment inks used in this embodiment.

As described above, the binarization unit 31 of FIG. 4 binarizes the bit map (C and M data) for the cyan (C) ink and the magenta (M) ink. When the binarized C and M data are as shown in FIG. 7 for example that is to form ink dots of the cyan (C) and magenta (M) inks in a printing region 50-1 (see FIG. 5), the following image processing is performed to generate the processing liquid ejection data. In FIG. 7, the data C for forming dots of the cyan (C) ink is represented as "C" and the data M for forming dots of magenta (M) is represented as "M". This representation also applies to other drawings.

First, based on the binary bit map (C and M data) for the cyan (C) and magenta (M) inks, the processing liquid data generation unit 33 (see FIG. 4) detects, with regards to every pixel, an order of scanning among a plurality of scannings at which the formation of an image by these inks is completed. To realize this, the processing liquid data generation unit 33 divides the data C and data M to pieces of data for the first scanning to the fourth scanning. The C and M data in the first, second, third, and fourth scannings of the printing region 50-1 corresponds to regions A, B, C, and D in the printing heads 22C and 22M (see FIG. 5). In this example, the data C is divided as shown in FIG. 8A to FIG. 8D and the data M is divided as shown in FIG. 9A to FIG. 9D. Then, as shown in FIG. 10A to FIG. 10D, the sum of the data C and the data M is calculated in each scanning. FIG. 11 shows the first scanning data (FIG. 10A) as "1", the second scanning data (FIG. 10B) as "2", the third scanning data (FIG. 10C) as "3", and the fourth scanning data (FIG. 10D) as "4". When different pieces of scanning data corresponds to a single pixel, data having a larger value is used. The reason is to sense a scanning at which the formation of the image by the inks is completed.

In the manner as described above, for each one pixel (for a predetermined region), an order of the scanning, among the plurality of scannings for forming the image, at which the image formation is completed (image formation completion scanning) is detected. Specifically, based on the data of FIG. 10A to FIG. 10D, the scanning number (1 to 4) at which the image formation is completed is detected. As will be described later, the processing liquid is ejected in two or more scanning after this image formation completion scanning.

Next, as shown in FIG. 12, "1" is added to the values of FIG. 11. As a result, the scanning number at the completion of the image formation by the inks is converted to the scanning number at which the formation of the transparent layer by the processing liquid is started. In FIG. 11, a margin pixel originally having no data is assumed as a pixel for which the image formation is already completed. For such a pixel, "1" is added so that the processing liquid can be ejected in the first scanning as will be described later. The above processing is the processing in the processing liquid data generation unit 33.

Next, the logical sum computation processing unit (OR circuit) 34 calculates the logical sum of the pattern of FIG. 6 previously stored in the processing liquid pattern storage unit 35 and the data generated by the processing liquid data generation unit 33 to generate the data of FIG. 13. This data is allocated to the first scanning to the fifth scanning by the printing head 22H for ejecting the processing. Specifically, the data calculated by means of logical sum is allocated, as shown in FIG. 14A to FIG. 14E, to the first, second, third, fourth, and fifth scannings in accordance with values of "1", "2", "3", "4", and "5" (in the example of FIG. 13, there is no data with value of "5"). In FIG. 14A to FIG. 14E, processing liquid ejection data (dots data) is represented as "H". As described above, the first, second, third, fourth, and fifth scannings use the ejection openings in the entire area γ (regions a, b, c, d, and e) in the printing head 22H.

By generating the processing liquid ejection data for the respective scannings as described above, the entire area γ of the regions of the printing head 22H for ejecting the processing liquid can be used as described above to eject the processing liquid. It is noted that the method for generating the processing liquid ejection data based on the ejection data of the respective ink colors and the method for distributing the processing liquid ejection data to the respective scannings are not limited to the above-described methods.

Next, a final scanning determination unit 36 (see FIG. 4) is used to determine, among the processing liquid ejection data, a data amount in the final scanning for ejecting only the processing liquid. In this example, for each predetermined unit printing area, the amount of the processing liquid ejection data in the final scanning (the fifth scanning) is compared with a predetermined threshold value. When the value of data amount is equal to or higher than the predetermined threshold value, the ejection data of the respective ink colors and the processing liquid ejection data are directly sent as print data to the image output section 30. Based on the print data, the image output section 30 uses the above-described the first printing method to form an image and a transparent layer.

Figure 14A:
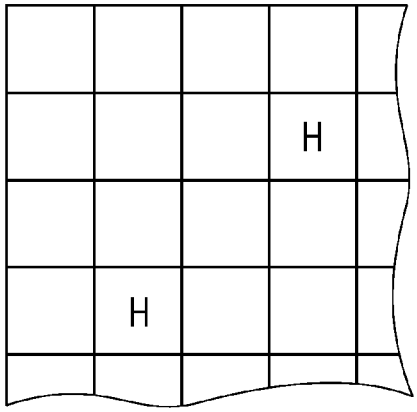
FIG. 14A to FIG. 14E illustrate ejection data for a processing liquid in the first scanning to the fifth scanning in FIG. 5, respectively.
Figure 14B:
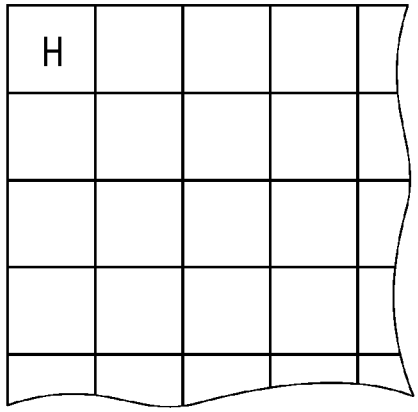
Figure 14C:
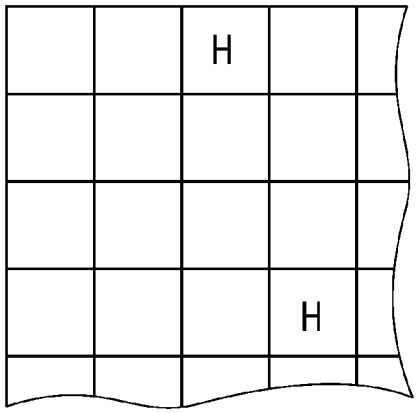
Figure 14D:
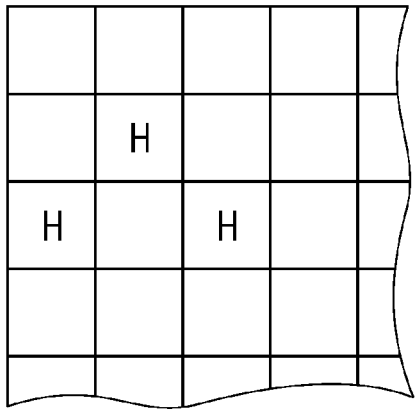
Figure 14E:
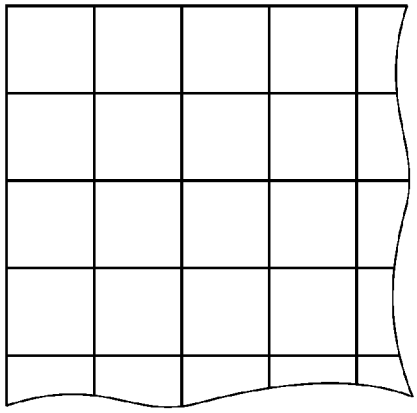

When the value of the data is lower than the predetermined threshold value on the other hand, the ejection data of the respective ink colors and the processing liquid ejection data are sent to a change unit 37. When the processing liquid ejection data does not exist in the final scanning (the fifth scanning) as shown in FIG. 14E for example, the ejection data of the respective ink colors and the processing liquid ejection data are sent to the change unit 37. In this example, when the processing liquid ejection data does not exist in the entire area of one page of the printing medium in the final scanning (the fifth scanning), the ejection data of the respective ink colors and the processing liquid ejection data are sent to the change unit 37. In this case, data for ejecting the processing liquid through the ejection opening of the region e does not exist over the entire area of one page of the printing medium.

Figure 15:
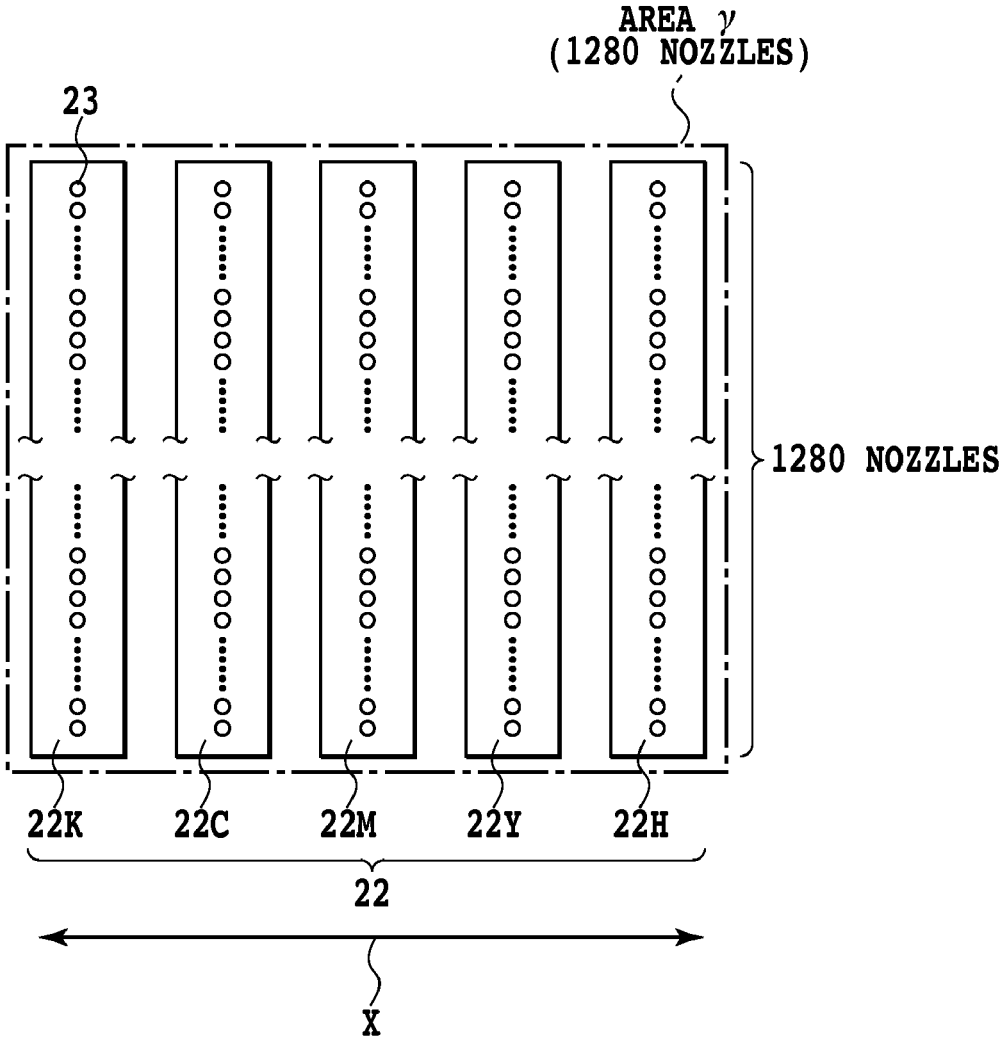
FIG. 15 illustrates a printing head used in the second printing method in the embodiment of the present invention seen from the ejection opening side.

The change unit 37 changes a printing method for forming the image layer of the ink and the transparent layer of the processing liquid from the above-described the first printing method to the second printing method (which will be described later). The second printing method is a multipath printing method by which the image layer of the ink and the transparent layer of the processing liquid are formed for each one pixel (for each predetermined area) through only four scannings. As shown in FIG. 15, the printing head for ejecting the respective colors of inks is used in the entire area γ. In this second printing method, the fifth scanning in the above-described first printing method does not exist (i.e., the final scanning (the fifth scanning) for ejecting only the processing liquid does not exist). Thus, the processing liquid ejection data in the fifth scanning is not required and thus is deleted.

As described above, the change unit 37 deletes the processing liquid ejection data for the fifth scanning and changes the printing method to the second printing method so that the printing operation is performed based on the ejection data of the respective colors of inks and the processing liquid ejection data in the first scanning to the fourth scanning. In this example, the processing liquid ejection data does not exist over the entire area of one page of the printing medium in the final scanning (the fifth scanning). Thus, the processing liquid ejection data was deleted. However, when the processing liquid ejection data for the final scanning (the fifth scanning) is equal to or lower than a predetermined threshold value, the processing liquid ejection data for the fifth scanning (the final scanning) to be deleted also may be added to the processing liquid ejection data for the fourth scanning (a scanning prior to the final scanning). When the printing method is changed to the second printing method, the change unit 37 generates the ejection data of the respective colors of inks and the processing liquid ejection data for the second printing method.

(Second Printing Method)

Figure 16:
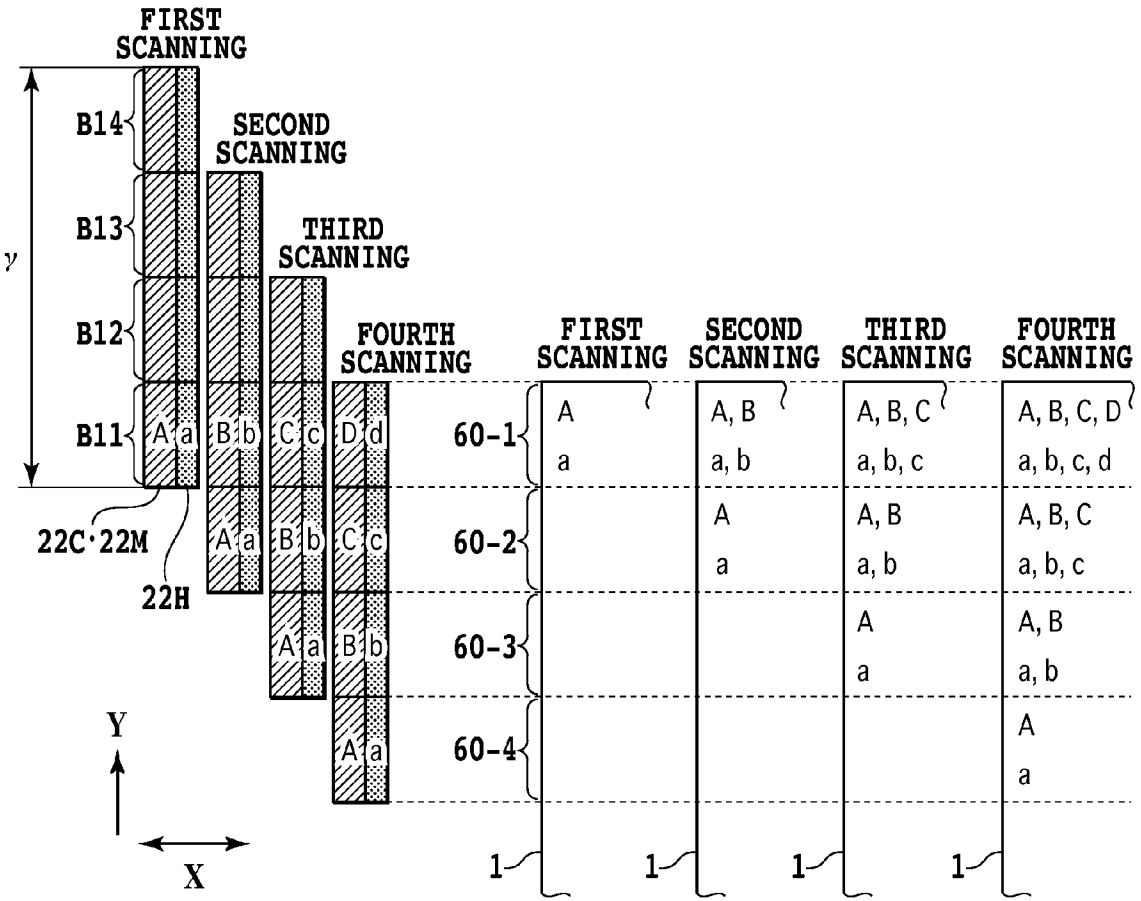
FIG. 16 illustrates the second printing method in the embodiment of the present invention.

FIG. 16 illustrates the second printing method. In the following section, for simple description, only cyan (C) ink and magenta (M) ink are used to print an image.

Each of the printing heads 22C and 22M for ejecting cyan (C) ink and magenta (M) ink and the printing head 22H for ejecting the processing liquid includes 1280 ejection openings equally divided to four blocks B11, B12, B13, and B14 each of which has 320 ejection openings. The printing heads 22C and 22M use the ejection openings in the area γ (see FIG. 15) of all of the blocks B11 to B14. In the following description, the ejection openings of the block B11 to B14 are also called as the ejection openings of the regions A, B, C, and D. The printing head 22H similarly uses 1280 ejection openings in the area γ of all of the blocks B11 to B14. In the following description, the ejection openings of the blocks B11 to B14 are also called as the ejection openings of the regions a, b, c, and d. In FIG. 16, 60-1, 60-2, 60-3, . . . each represent a printing region on the printing medium 1 corresponding to one block of the printing head.

First, in the first scanning, based on the ejection data of the printing region 60-1 in the first scanning, the ink is ejected through the ejection openings in the region A of the printing heads 22C and 22M. Based on the processing liquid ejection data in the first scanning, the processing liquid is ejected through the ejection openings in the region a of the printing head 22H.

Next, the printing medium 1 is transported in the sub-scanning direction (direction shown by arrow Y) by a distance of ¼ of the length of the printing head. In FIG. 16, the printing head is represented as being relatively moved in an opposite direction to the sub-scanning direction.

In the subsequent second scanning, based on the ejection data in the second scanning of the printing region 60-1, the ink is ejected through the ejection openings in the region B of the printing heads 22C and 22M. Based on the processing liquid ejection data for the second scanning, the processing liquid is ejected through the ejection openings in the region b of the printing head 22H. In this second scanning, the first scanning to the printing region 60-2 is performed.

Next, the printing medium 1 is transported in the sub-scanning direction by the distance ¼ of the length of the printing head. In the subsequent third scanning, based on the ejection data for the third scanning of the printing region 60-1, the ink is ejected through the ejection openings in the region C of the printing heads 22C and 22M. Based on the ejection data for the processing liquid at the third scanning, the processing liquid is ejected through the ejection openings in the region c of the printing head 22H. In this third scanning, the second scanning to the printing region 60-2 and the first scanning to the printing region 60-3 are performed.

Next, the printing medium 1 is transported in the sub-scanning direction by the distance of ¼ of the length of the printing head. In the subsequent fourth scanning, based on the ejection data for the fourth scanning of the printing region 60-1, the ink is ejected through the ejection openings in the region D of the printing heads 22C and 22M. Based on the processing liquid ejection data for the fourth scanning, the processing liquid is ejected through the ejection openings in the region d of the printing head 22H. In this fourth scanning, the third scanning to the printing region 60-2, the second scanning to the printing region 60-3, and the first scanning to the printing region 60-4 are performed.

By the first to fourth scannings as described above, the printing of the image to the printing region 50-1 and the formation of the transparent layer 26 are completed.

Thereafter, by repeating the same scanning, the printing of images to the printing regions 60-2, 60-3, . . . and the formation of the transparent layer 26 are completed sequentially.

(Relation Between First and Second Printing Methods)

Figure 17:
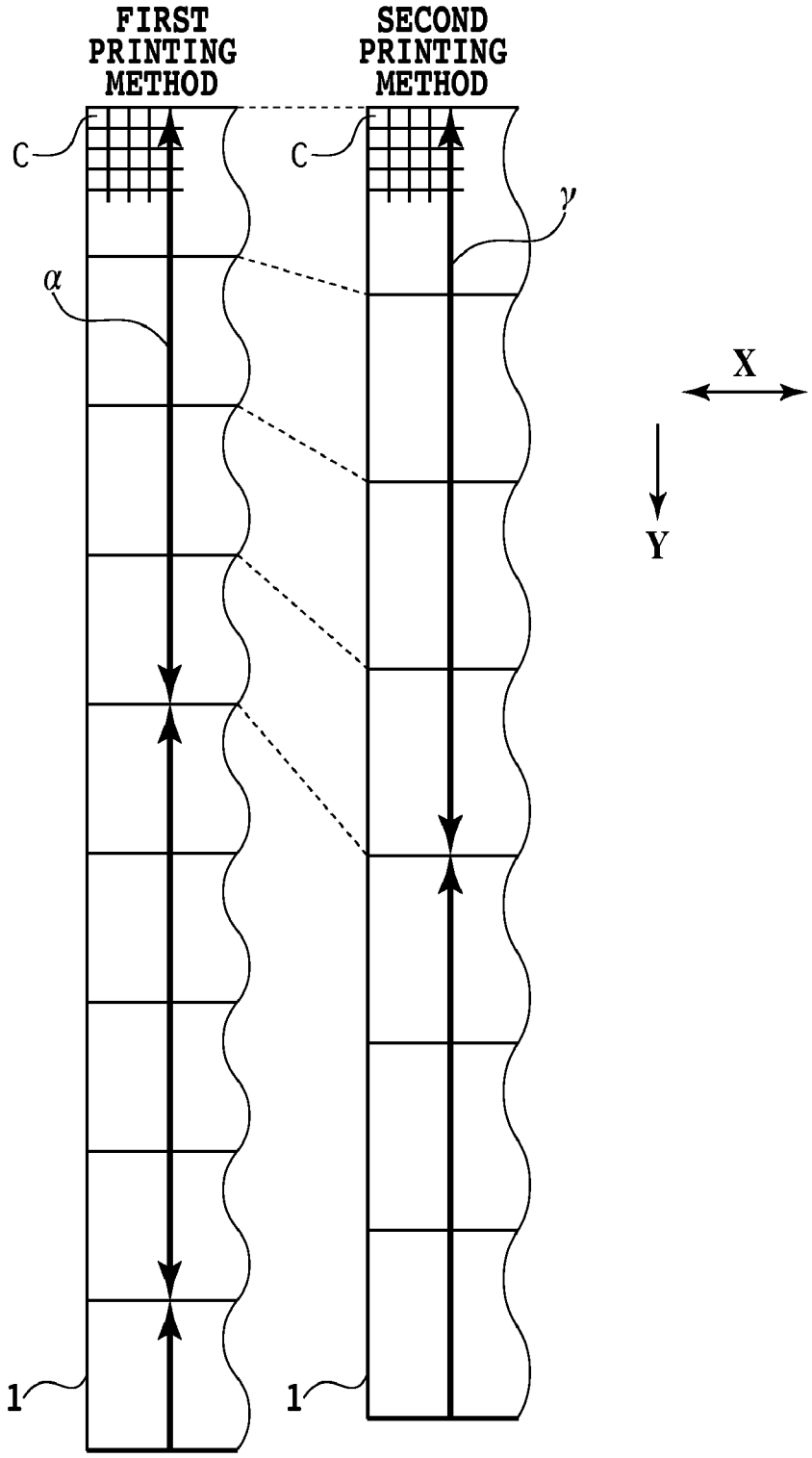
FIG. 17 illustrates a relation between the first and second printing methods in the embodiment of the present invention.

FIG. 17 illustrates a relation between the first printing method and the second printing method.

In the first printing method at the left side of FIG. 17, the printing is performed by ejection openings in the area α having a width that is ⅘ of the width of the printing head.

Thus, the ejection data of the respective colors of inks and the processing liquid ejection data are divided based on the width of ⅕ of the width of the printing head. On the other hand, in the second printing method at the right side of FIG. 17, the printing is performed by the ejection openings in the entire area of the printing head (area γ). Thus, the ejection data of the respective colors of inks and the processing liquid ejection data are divided based on the width of ¼ of the width of the printing head. The change unit 37 subjects all ejection data to such a change to send the changed ejection data as print data to the image output section 30.

As described above, in this example, when there is no ejection data for which the processing liquid should be ejected in the final scanning (the fifth scanning), in which only the processing liquid is ejected, in the first printing method, the printing method is changed to the second printing method. Specifically, the processing liquid ejection data for the final scanning in the first printing method is deleted, the printing width for one scanning is changed, and the ejection openings in the entire area of the printing head are used to form the image and the transparent layer through four scannings.

Figure 21:
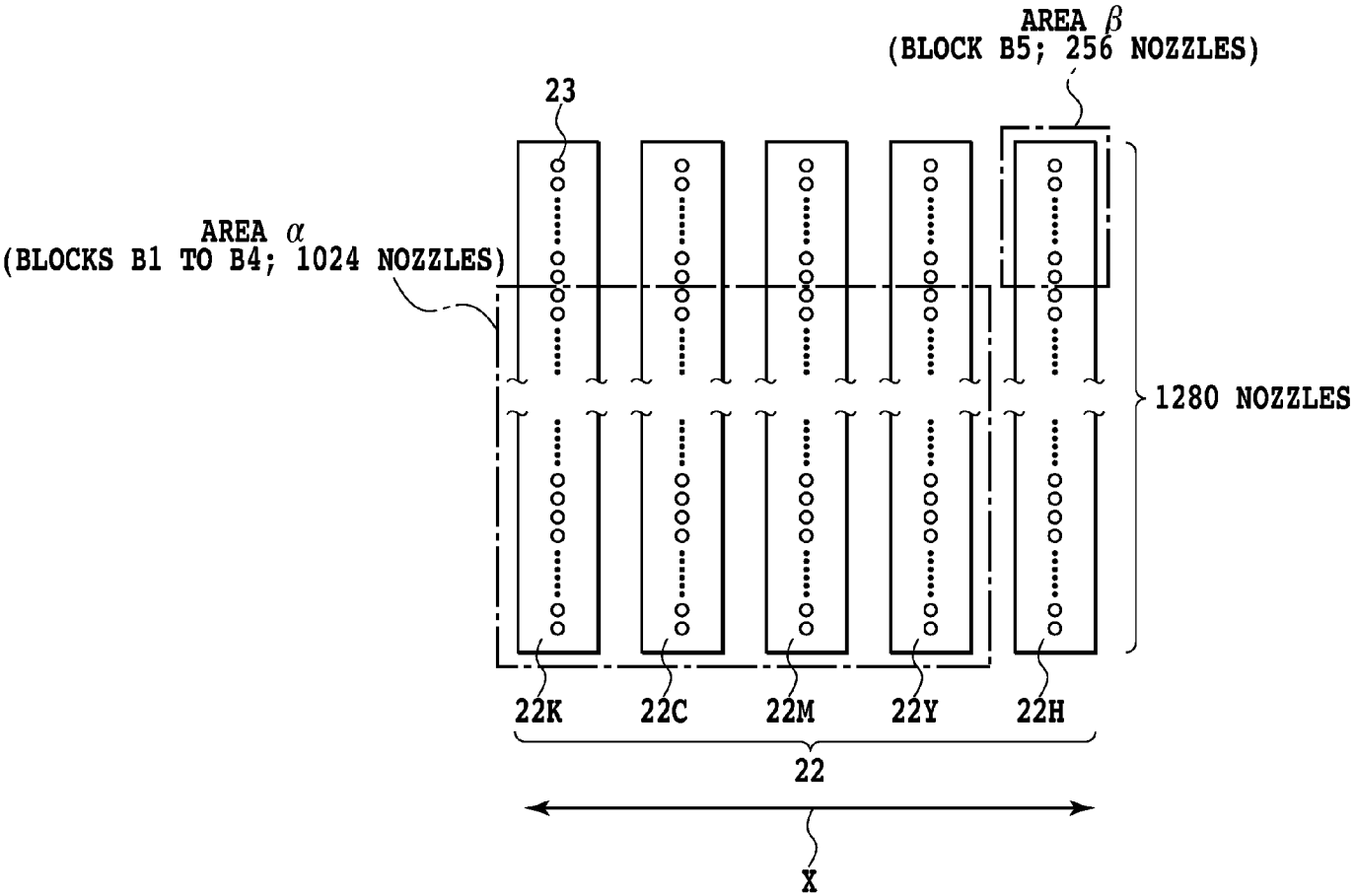
FIG. 21 illustrates a printing head in a printing method as a comparison example when seen from the ejection opening side.

In any of the first and second printing methods, a timing for ejecting the processing liquid is divided to a plurality of scannings. Thus, the drying of the processing liquid on the printing medium and the printed image can be promoted to improve many defective images due to flooded ink and interference pattern phenomenon. Furthermore, since the processing liquid is ejected through the wide area of nozzles provided in the printing head for ejecting the processing liquid, specific nozzles can be prevented from being used in a concentrated manner, thus providing the nozzles with improved durability. When a timing for ejecting the processing liquid is only the final scanning (the fifth scanning) in the first printing method, the nozzles in the area β in FIG. 21 are used in the concentrated manner and thus the nozzles may have deteriorated durability.

In the first printing method, when the amount of the processing liquid ejection data in the final scanning (the fifth scanning) is "0" or equal to or lower than the predetermined amount, the printing method can be changed to the second printing method, thus increasing the printing speed. Specifically, in the second printing method, the final scanning (the fifth scanning) for ejecting the processing liquid in the first printing method is eliminated to increase the printing region per one scanning. Thus, the number of scannings required to print the image in the printing region of the predetermined unit (e.g., one page unit) can be reduced. When the processing liquid ejection data in the final scanning (the fifth scanning) of the first printing method exists in an amount equal to or lower than a predetermined amount, the processing liquid ejection data may be deleted or also may be added to the processing liquid ejection data in the scanning immediately before the final scanning (the fourth scanning).

Other Embodiments

Figure 18:
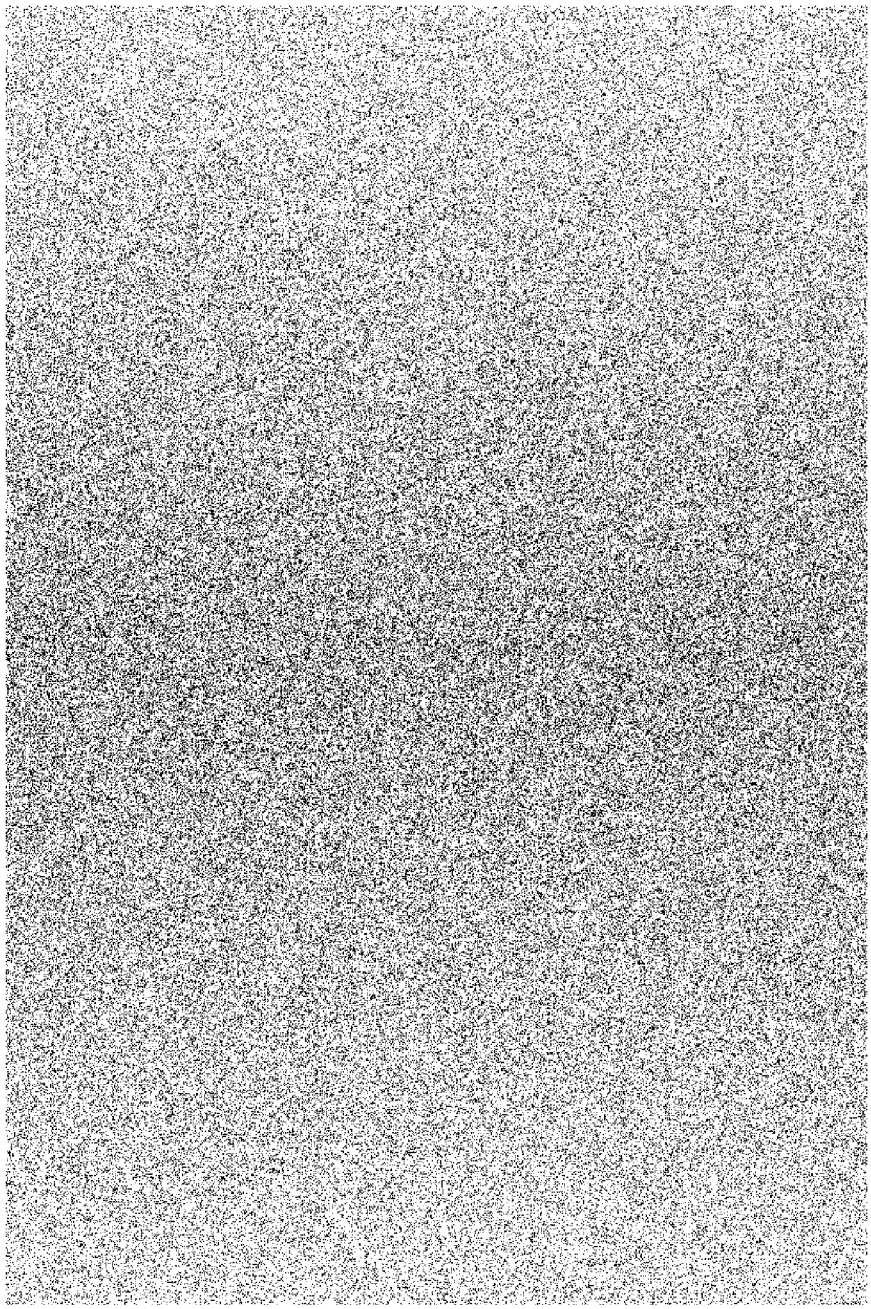
FIG. 18 illustrates an image of a mask pattern having a gradation shape.

In the above-described embodiment, based on the inputted binary bit map data of the respective colors of inks, the processing liquid ejection data was generated. A mask pattern generally used for forming an image in the multipath printing apparatus in recent years has the gradation shape as shown in FIG. 18. An ink ejection duty in the multipath printing (ink ejection amount to unit printing area) is low in the first scanning and is gradually increased in the subsequent scanning and is highest in the middle scanning. Then, the ejection duty gradually decreases in the subsequent scannings and is lowered in the final scanning as in the first scanning. Thus, in the second half scannings for forming an image, a ratio of the generation of the processing liquid ejection data increases naturally. This can be used to prepare a processing liquid ejection mask pattern in advance based on the mask pattern used for forming the image of ink. The change unit 37 also may change the mask pattern to change the ink ejection data per one scanning.

In the above-described embodiment, the final scanning determination unit 36 determines the existence or nonexistence of the processing liquid ejection data for the final scanning. When the processing liquid ejection data does not exist, the change unit 37 changes the printing method. In order to prevent the image surface from being peeled or damaged due to the contact with a nail, an ejection pattern of the processing liquid (a pattern of dots formed by the processing liquid (dot pattern)) does not always has to be a 100%-solid pattern completely covering a glossy paper and a pigment ink layer. In the case of some material included in the processing liquid, a favorable abrasion resistance also can be obtained even when the coverage is 50% or less as described above. Thus, if sufficient abrasion resistance is obtained, 5% of the required dot pattern for the processing liquid for example may be used as a threshold value to determine the amount of the processing liquid ejection data for the final scanning. In this case, the processing liquid ejection data of 5% or less (processing liquid ejection data for the final scanning) may be deleted as in the above-described embodiment or may be added to the processing liquid ejection data in the scanning prior to the final scanning. Alternatively, the processing liquid ejection data of 5% or less also may be corrected so as to dislocate the positions of formed dots to subsequently add the data to the processing liquid ejection data for the scanning prior to the final scanning. Specifically, the processing liquid ejection data of 5% or less is corrected so that the positions of dots formed based on the processing liquid ejection data of 5% or less are dislocated from the original positions to the positions of pixels for which the image formation by ink is completed. Then, the corrected data may be added to the processing liquid ejection data in the scanning prior to the final scanning.

In the above-described embodiments, the printing head is structured so that the ejection openings constituting a nozzle for ejecting the pigment ink and the ejection openings constituting a nozzle for ejecting the processing liquid are arranged in the main scanning direction. However, another printing head also can be used that is structured so that the ejection openings for ejecting the pigment ink and the ejection openings for ejecting the processing liquid are arranged in a dislocated manner in a direction crossing the main scanning direction (e.g., the sub-scanning direction). Nozzles for ejecting the processing liquid also may be provided in an amount larger than the amount of nozzles for ejecting the pigment ink and the former nozzles also may be arranged in a nozzle array longer than that in which the latter nozzles are arranged.

In the present invention, the processing liquid may be ejected in two or more scannings among a plurality of scannings to a predetermined area for which the image formation is completed. Thus, the processing liquid may be ejected in three or more scannings. When an image in a predetermined area is formed by the maximum n scannings of the printing head (n is an integer of two or more), the processing liquid also may be ejected in two or more scannings prior to the nth scanning of the printing head. Alternatively, the processing liquid also may be ejected in two or more scannings including at least one scanning after the nth scanning of the printing head.

In the above-described embodiment, the amount of data for ejecting the processing liquid in the final scanning corresponds to the number of ejections of the processing liquid per a unit area. When the data amount is equal to or lower than the predetermined amount, the data amount was changed so as to reduce the number of scannings. However, in the present invention, among the processing liquid ejection data generated to eject the processing liquid in two or more scannings, in accordance with the data for ejecting the processing liquid in the final scanning, the number of scannings for ejecting the processing liquid may be changed.

When an image of a predetermined area is formed by the maximum number n of scannings of the printing head (n is an integer of 2 or more), the processing liquid ejection data for ejecting the processing liquid can include the first data and the second data as described below. The first data is data for ejecting the processing liquid in two or more scannings including at least one scannings on or after the nth scanning of the printing head. The second data is data for ejecting the processing liquid in at least two scannings on or before the nth scanning of the printing head.

As in the above-described embodiment, in accordance with the number of scannings for ejecting the processing liquid, an image formation area per one scanning of the printing head and an area covered by the processing liquid can be changed to improve the throughput of the printing apparatus. A timing at which the areas are changed may be set based on at least one of a page unit of the printing medium, a printing job unit, a timing for changing the type of the printing medium, and a position of a margin of the printing medium where no image is formed.

When the ink ejection data for ejecting the ink through the printing head is allocated to a plurality of scannings by the mask pattern, the mask pattern also can be used to generate the processing liquid ejection data. A ratio of thinning out, by using the processing liquid mask pattern, the processing liquid ejection data corresponding to a plurality of predetermined areas is not limited to those of the above-described embodiment.

The processing liquid also may be ejected to a predetermined area in which no image by the ink is formed in at least one scannings among the plurality of scannings of the printing head. For example, the processing liquid can be ejected in the first scanning among a plurality of scannings of the printing head. When the image in a predetermined area is formed by the maximum n scannings of the printing head (n is an integer of two or more), the processing liquid also may be ejected in the first scanning after the nth scanning of the printing head.

In the above-described embodiment, a margin pixel for which no data originally exists as shown in FIG. 11 is set with "1" as in FIG. 12 so that a timing for ejecting the processing liquid regarding a pixel having no ejection data for the respective colors of inks (margin) is set in the first scanning. However, the same effect can be obtained even when the timing for ejecting the processing liquid is divided to a plurality of scannings. Thus, the number of division and the division method are not limited. Furthermore, the processing liquid may not be ejected for a pixel having no pigment ink ejection data (margin pixel).

In the above-described embodiment, the processing liquid is ejected after a scanning next to a scanning at which the image formation is completed. However, the processing liquid also may be ejected in the same scanning as the scanning at which the image formation is completed so long as the image formation by the pigment ink is completed. In this case, the printing head (FIG. 2) in the above-described embodiment having one ejection opening array for ejecting the processing liquid can be used to eject the processing liquid in the same scanning as that of a printing in one direction in a bidirectional printing method (one direction shown by arrow X1). When a printing head having ejection opening arrays for ejecting the processing liquid at both ends is used, the opening arrays to be used to eject the processing liquid can be switched depending on the printing direction. Thus, the processing liquid also can be ejected in the same scanning as that of the printing in any printing direction in the bidirectional printing method.

The printing head also may eject one type of ink for forming an image or also may eject a plurality of different inks.

In the above-described embodiments, in addition to the pigment ink used for the image formation, the processing liquid for improving the image performance of the pigment ink (abrasion resistance in the above-described embodiments) is used. As described above, the processing liquid is basically used separately from the image formation. Thus, the processing liquid is preferably transparent and colorless. However, among the pigment inks used for image formation such as light cyan ink, light magenta ink, and light gray ink, a part or the entirety of light-color pigment ink also may be added with material for improving a function such as abrasion resistance so that the colored ink can function to achieve both of image formation and an improved function such as abrasion resistance. In this case, a processing liquid tank separately provided for the one for ink or an additional component such as a printing head (which corresponds to a component required by the addition of one color of ink) is not required. Thus, this can contribute a lot to miniaturization and price-reduction of the printing apparatus. Among the pigment inks used for image formation, a part or the entirety of deep-color pigment ink also may function as the processing liquid.

The predetermined area can be set as an area corresponding to a dot formed by the ink on the printing medium or also may be set as various areas. Although the processing liquid desirably includes a resin component for forming a transparent layer on the surface of the printing medium, various processing liquid also can be used.

The present invention can be used for various printing apparatuses using a printing medium such as a paper, cloth, nonwoven cloth, or an OHP film. Specifically, the present invention can be applied to a business machine such as a printer, a copier, or a facsimile.

Figure 22:
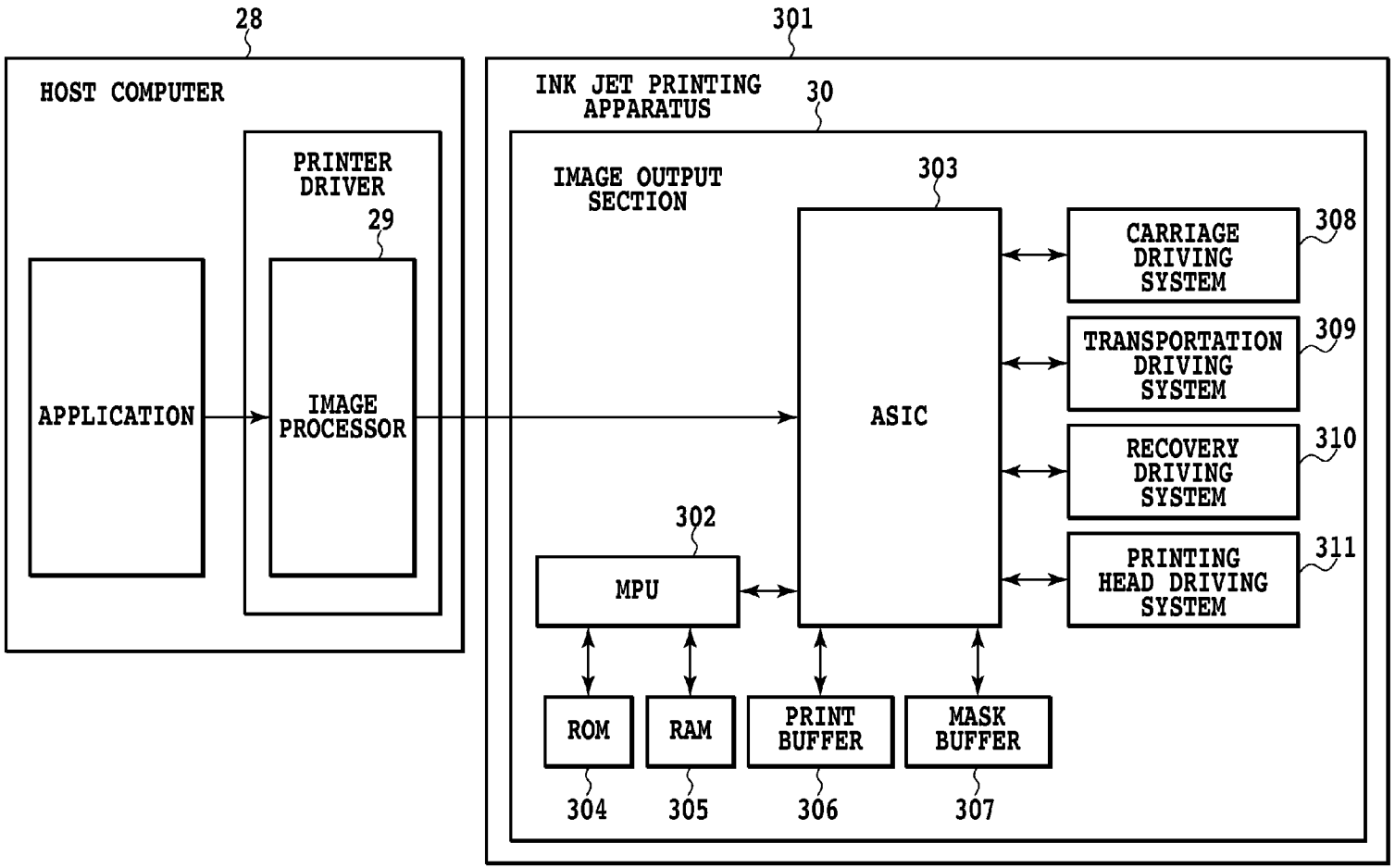
FIG. 22 illustrates a schematic configuration of an ink jet printing system to which the present invention can be applied.

Although the above-described embodiments has described a case where the image processor 29 for performing the characteristic processing of the present invention is provided in the ink jet printing apparatus, the image processor 29 is not required to be provided in the ink jet printing apparatus. For example, as shown in FIG. 22, a printer driver of a host computer connected to the ink jet printing apparatus also may have the function of the image processor 29. In this case, the printer driver generates pigment ink ejection data and processing liquid ejection data based on multivalued image data received from an application to supply the data to the ink jet printing apparatus 301. As described above, the ink jet printing system including the host computer and the ink jet printing apparatus 301 is also included in the scope of the present invention. In this case, the host computer functions as a data supply apparatus that supplies data to the ink jet printing apparatus and also functions as a control apparatus for controlling the ink jet printing apparatus.

The present invention is mainly characterized in the data processing carried out by the image processor 29. Thus, a data generating apparatus including the image processor 29 for carrying out the characteristic data processing of the present invention is also included in the scope of the present invention. When the image processor 29 is included in an ink jet printing apparatus, this ink jet printing apparatus functions as the data generating apparatus of the present invention. When the image processor 29 is included in a host computer, this host functions as the data generating apparatus of the present invention.

A computer program for causing a computer to carry out the above-described characteristic data processing and a storage medium storing the program so that the program can be read by the computer are also included in the scope of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-242665, filed Sep. 19, 2007, which is hereby incorporated by reference herein in its entirety.

What is claimed is:

1. An ink jet printing apparatus in which a printing head that can eject an ink and a processing liquid from a plurality of ejection openings forming an ejection opening array is subjected to a plurality of scannings to a predetermined area on a printing medium to form an image by the ink on the printing medium and to cover the formed image by the processing liquid, said ink jet printing apparatus comprising:

a generation unit that generates processing liquid ejection data with regard to the predetermined area for which the formation of the image is completed, the processing liquid ejection data being for ejecting the processing liquid from the printing head in a plurality of scannings of the printing head;

a control unit that changes, in accordance with the processing liquid ejection data for a final scanning for ejecting only the processing liquid among the processing liquid ejection data generated by the generation unit, a region per one scanning of the printing head within which the ejection opening array of the printing head is used to form the image and to cover the formed image; and an ejection unit that causes the printing head to eject the processing liquid based on the processing liquid ejection data generated by the generation unit, wherein the generation unit generates different processing liquid ejection data depending on the change by the control unit.

2. The ink jet printing apparatus according to claim 1, wherein the control unit expands, when an amount of the processing liquid ejection data for the final scanning for ejecting only the processing liquid is equal to or lower than a predetermined amount, the region per one scanning of the printing head within which the ejection opening array of the printing head is used to form the image and to cover the formed image.

3. The ink jet printing apparatus according to claim 2, wherein the amount of the processing liquid ejection data corresponds to the number of ejections of the processing liquid per a unit area.

4. The ink jet printing apparatus according to claim 1, wherein the printing head can eject a plurality of different inks as the ink.

5. The ink jet printing apparatus according to claim 1, wherein the predetermined area corresponds to dots formed on the printing medium by the ink.

6. An ink jet printing method by which a printing head that can eject an ink and a processing liquid from a plurality of ejection openings forming an ejection opening array is subjected to a plurality of scannings to a predetermined area on a printing medium to form an image by the ink on the printing medium and to cover the formed image by the processing liquid, said method comprising the steps of:

a generation step for generating processing liquid ejection data with regard to the predetermined area for which the formation of the image is completed, the processing liquid ejection data being for ejecting the processing liquid from the printing head in a plurality of scannings of the printing head;

a control step for changing, in accordance with the processing liquid ejection data for a final scanning for ejecting only the processing liquid among the processing liquid ejection data generated by the generation step, a region per one scanning of the printing head within which the ejection opening array of the printing head is used to form the image and to cover the formed image; and an ejection step for causing the printing head to eject the processing liquid based on the processing liquid ejection data generated by the generation step, wherein the generation step generates different processing liquid ejection data depending on the change by the control step.

* * * * *